US006486390B2

(12) United States Patent
Aoki et al.

(10) Patent No.: US 6,486,390 B2
(45) Date of Patent: Nov. 26, 2002

(54) APPARATUS AND METHOD FOR CREATING MELODY DATA HAVING FORWARD-SYNCOPATED RHYTHM PATTERN

(75) Inventors: Eiichiro Aoki, Hamamatsu (JP); Toshio Sugiura, Hamamatsu (JP)

(73) Assignees: Yamaha Corporation (JP); Optnix Co., Ltd. (JP)

( * ) Notice: Subject to any disclaimer, the term of this patent is extended or adjusted under 35 U.S.C. 154(b) by 0 days.

(21) Appl. No.: 09/768,706

(22) Filed: Jan. 24, 2001

(65) Prior Publication Data

US 2001/0020412 A1 Sep. 13, 2001

(30) Foreign Application Priority Data

Jan. 25, 2000 (JP) ..... 2000-15139

(51) Int. Cl.[7] ..... G10H 1/38; G10H 1/42

(52) U.S. Cl. ..... 84/611; 84/613; 84/651; 84/DIG. 12; 84/DIG. 22

(58) Field of Search ..... 84/609–614, 634–638, 84/649–652, 666–669, DIG. 12, DIG. 22

(56) References Cited

U.S. PATENT DOCUMENTS

| | | | | |
|---|---|---|---|---|
| 5,736,663 A | | 4/1998 | Aoki et al. | 84/609 |
| 6,143,971 A | * | 11/2000 | Aoki et al. | 84/609 |
| 6,162,982 A | * | 12/2000 | Aoki | 84/611 |
| 6,245,984 B1 | * | 6/2001 | Aoki et al. | 84/611 |

* cited by examiner

*Primary Examiner*—Stanley J. Witkowski
(74) *Attorney, Agent, or Firm*—Rossi & Associates

(57) ABSTRACT

A rhythm pattern is provided to be subjected to forward syncopation processing. The time position of an un-syncopated note in the rhythm pattern is shifted forward to render advanced beating of the note to make a forward-syncopated rhythm pattern. The notes in the modified rhythm pattern are given respective note pitches to establish a melody, wherein the skeleton notes in the rhythm pattern are given skeleton pitches, and the non-skeleton notes in the rhythm pattern are given non-skeleton pitches. The advanced beating of a note makes a skeleton note which plays an important role in syncopation.

16 Claims, 16 Drawing Sheets

Melody Creation with Stored Skeleton Indexes

Hardware Structure

*Fig. 2* Melody Creation with Stored Skeleton Indexes
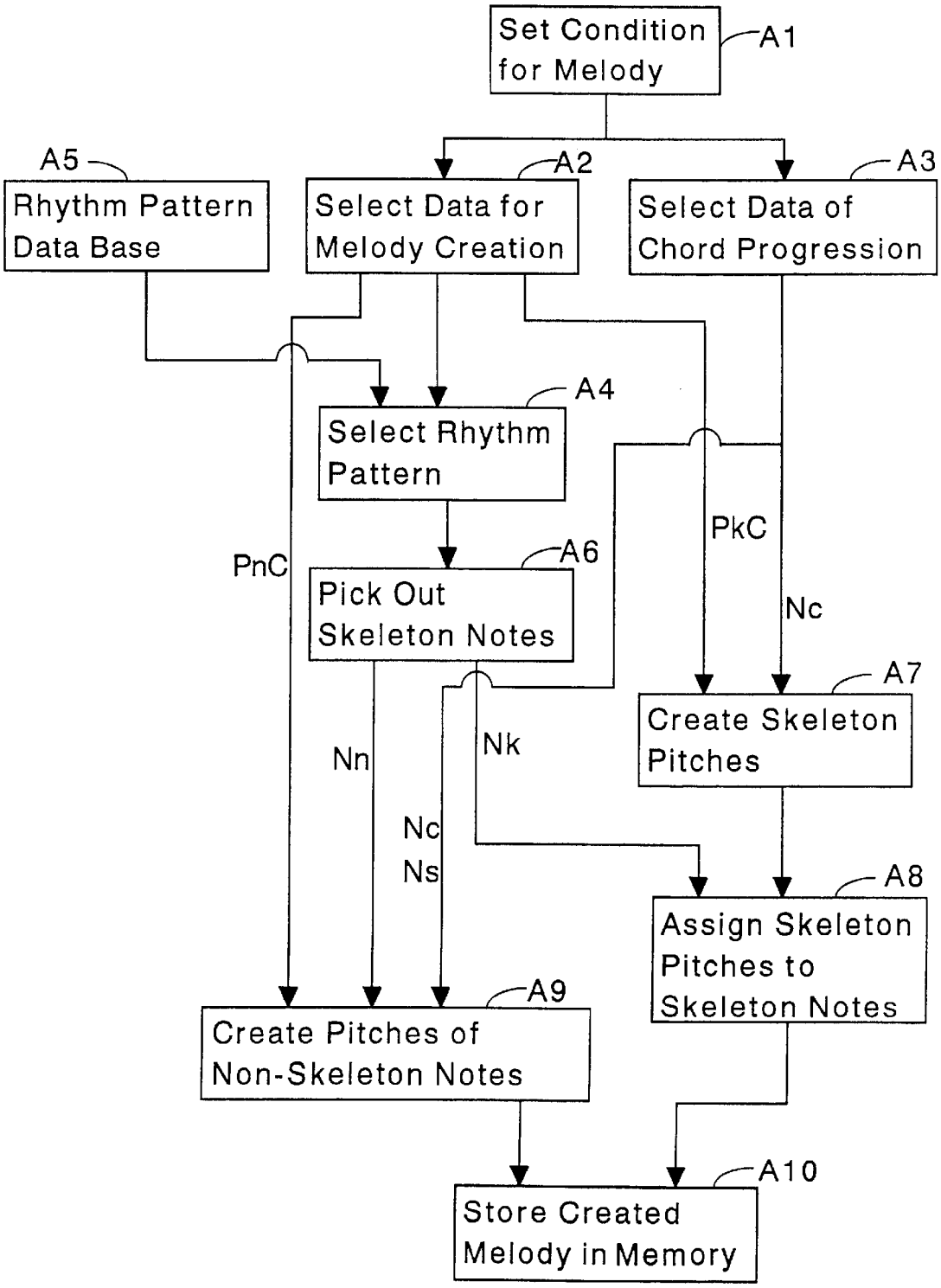

Rhythm Pattern Data #1 (Time Section Mapping)

| Time Section Ts | Note Mark Nb | Skeleton Mark Sk |
|---|---|---|
| 0 | "1" (is) | "1" (yes) |
| 1 | "0" (not) | "0" (non) |
| 2 | "0" (not) | "0" (non) |
| 3 | "1" (is) | "0" (non) |
| 4 | "1" (is) | "1" (yes) |
| 5 | "0" (not) | "0" (non) |
| 6 | "1" (is) | "0" (non) |
| 7 | "0" (not) | "0" (non) |

Rhythm Pattern #1 (Note Illustration)

*Fig. 3c*

Rhythm Pattern Data #1
(Event Notation)

| Time Section (Abs) A | Skeleton Mark Sk |
|---|---|
| 0 | "1" |
| 3 | "0" |
| 4 | "1" |
| 6 | "0" |

*Fig. 3d*

Rhythm Pattern Data #1
(Event Notation)

| Time Section (Rel) B | Skeleton Mark Sk |
|---|---|
| 0 | "1" |
| 3 | "0" |
| 1 | "1" |
| 2 | "0" |

Rhythm Pattern Data #2 (Time Section Mapping)

| Adress | | Rhythm Pattern Info | |
|---|---|---|---|
| Upper Bit | Lower Bit | Note Mark | Skeleton Mark |
| Measure Br | Time Section Ts | Nb | Sk |
| n | 0 | "1" (is) | "1" (yes) |
| | 1 | "0" (not) | "0" (non) |
| | 2 | "0" (not) | "0" (non) |
| | 3 | "1" (is) | "0" (non) |
| | 4 | "1" (is) | "1" (yes) |
| | 5 | "0" (not) | "0" (non) |
| | 6 | "1" (is) | "0" (non) |
| | 7 | "0" (not) | "0" (non) |

Forward-Syncopated Rhythm
(Intra-Measure Shifting)

Forward-Syncopated Rhythm
(Inter-Measure Shifting)

*Fig. 6a*
Unsyncopated Rhythm Pattern
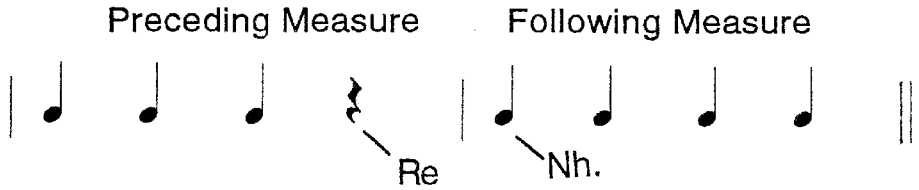
*Fig. 6b*
Unsyncopated Rhythm Pattern
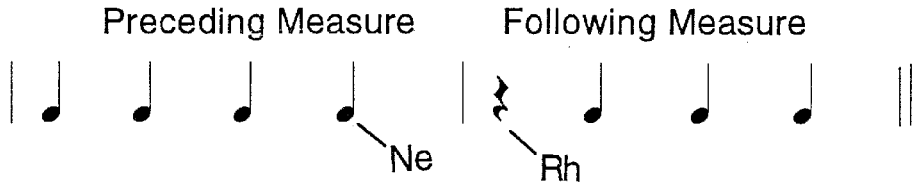
*Fig. 6c*
Unsyncopated Rhythm Pattern
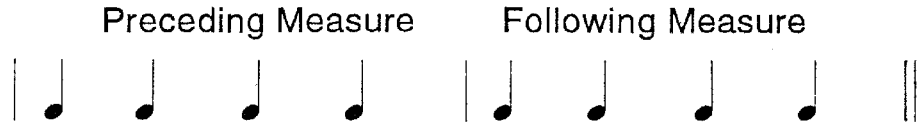
*Fig. 6d*
Unsyncopated Rhythm Pattern
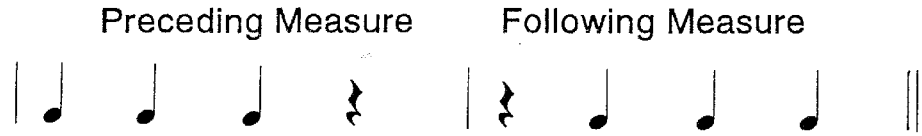
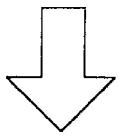
*Fig. 6e*
Syncopated Rhythm Pattern
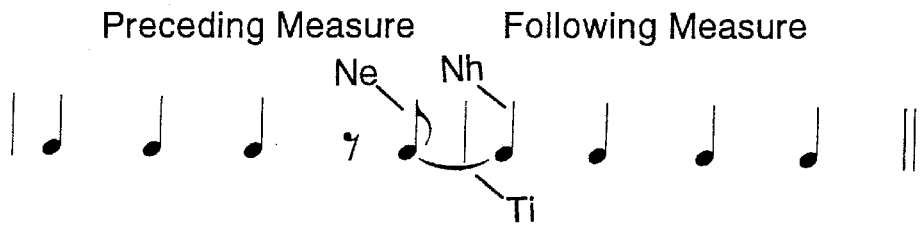

*Fig. 7* Melody Creation with Forward Syncopation (1)
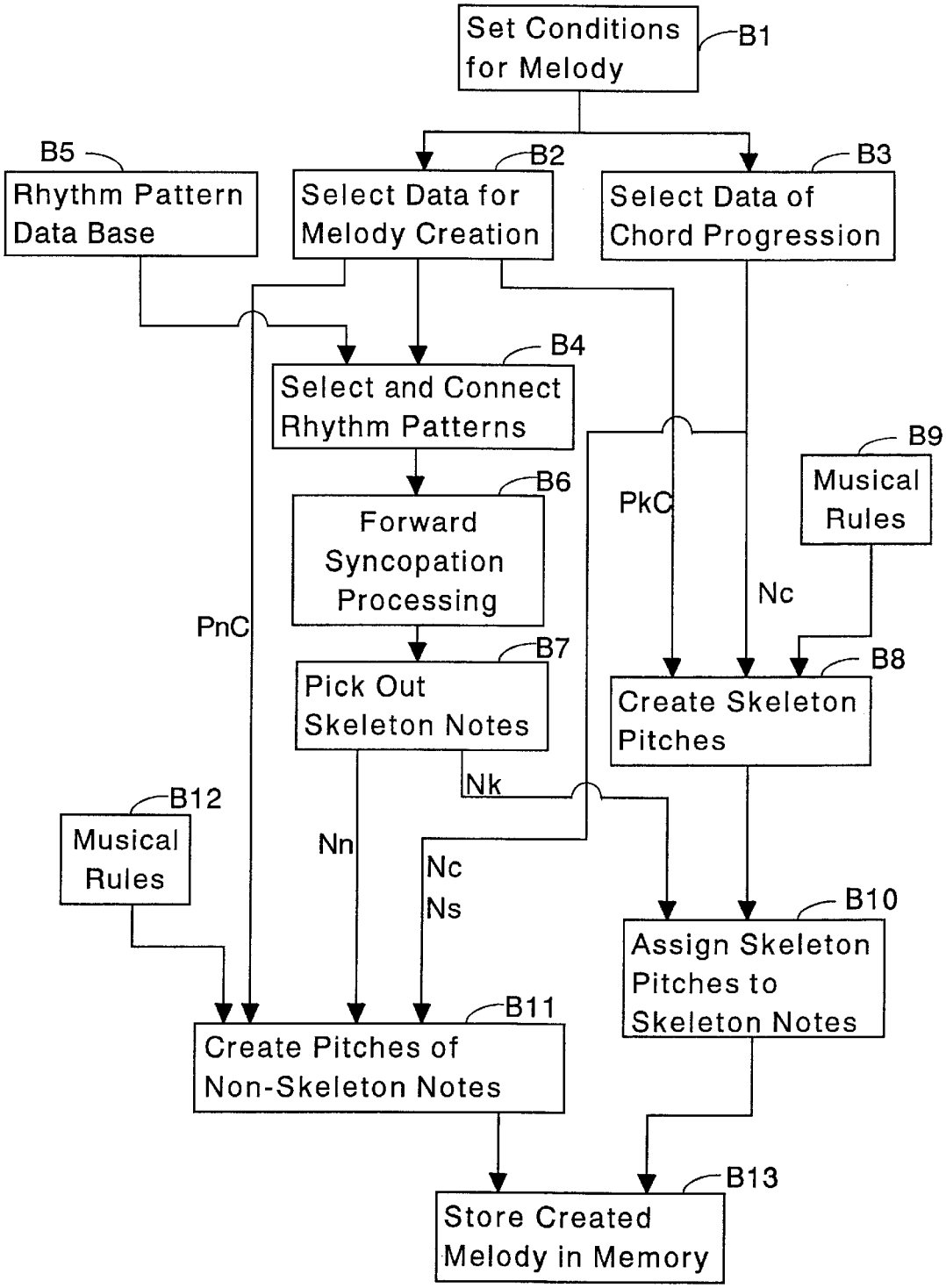

*Fig. 8* Forward Syncopation Processing (1-A)
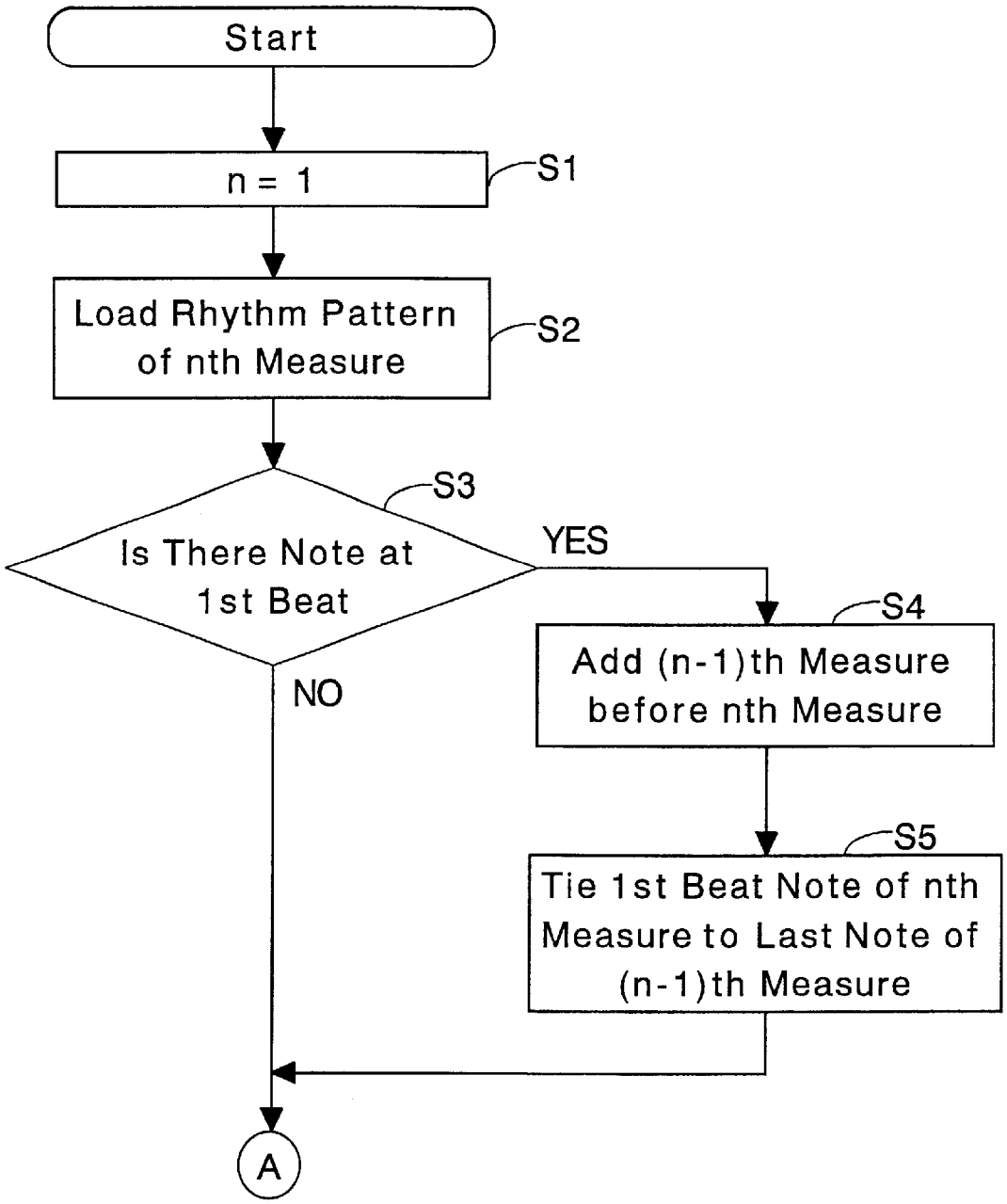

*Fig. 9* Forward Syncopation Processing (1-A)
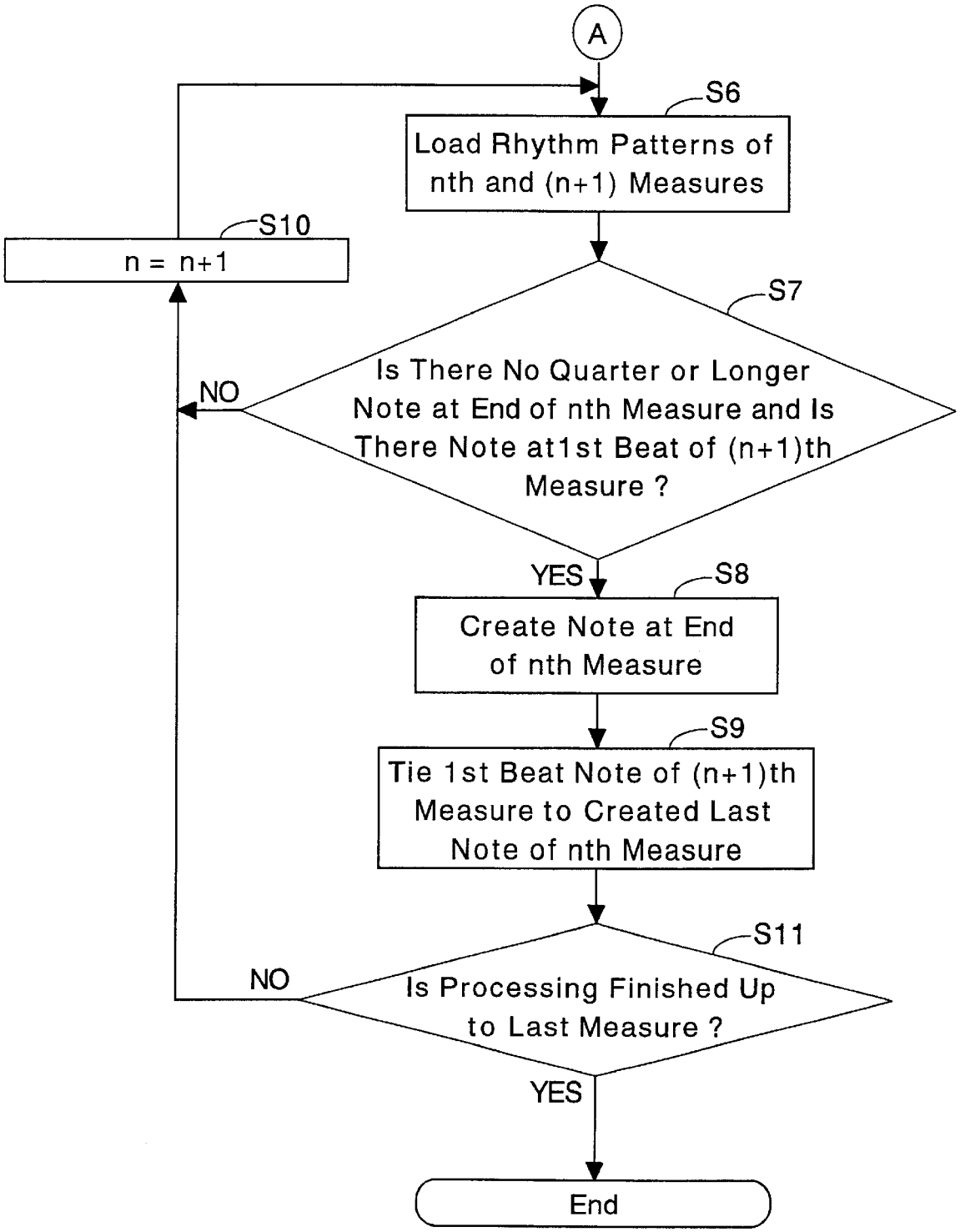

*Fig. 10*

Rhythm Pattern Detectable of Note Missing Span

| Time Section Ts | Note Info Nt | |
|---|---|---|
| | Note Existance Nx | Note Length Ln |
| 0 | "1" | "1" |
| 1 | "0" | |
| 2 | "1" | "2" |
| 3 | "1" | |
| 4 | "1" | "2" |
| 5 | "1" | |
| 6 | "1" | "1" |
| 7 | "0" | |

*Fig. 11* Forward Syncopation Processing (1-B)
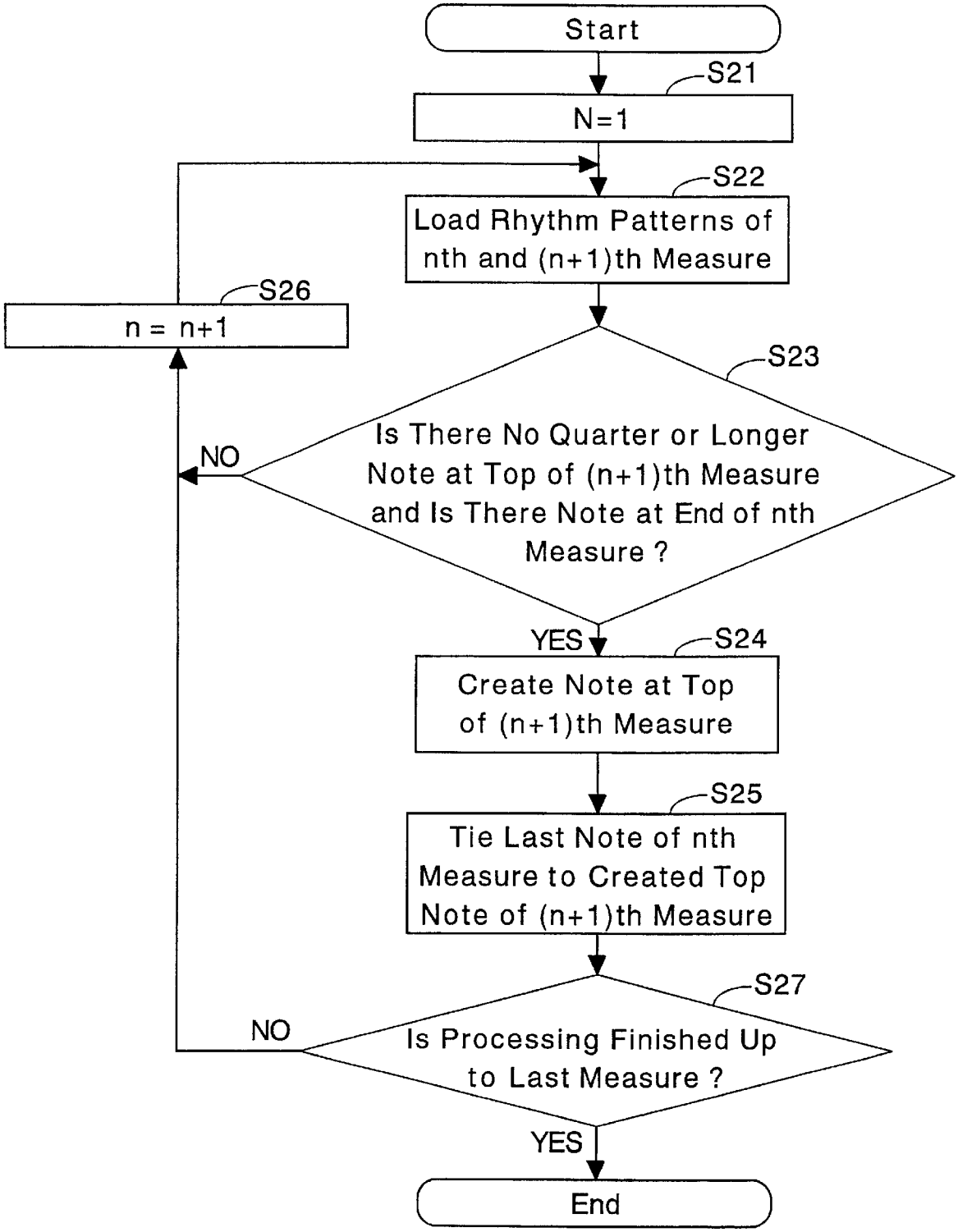

*Fig. 12* Melody Creation with Forward Syncopation (2)
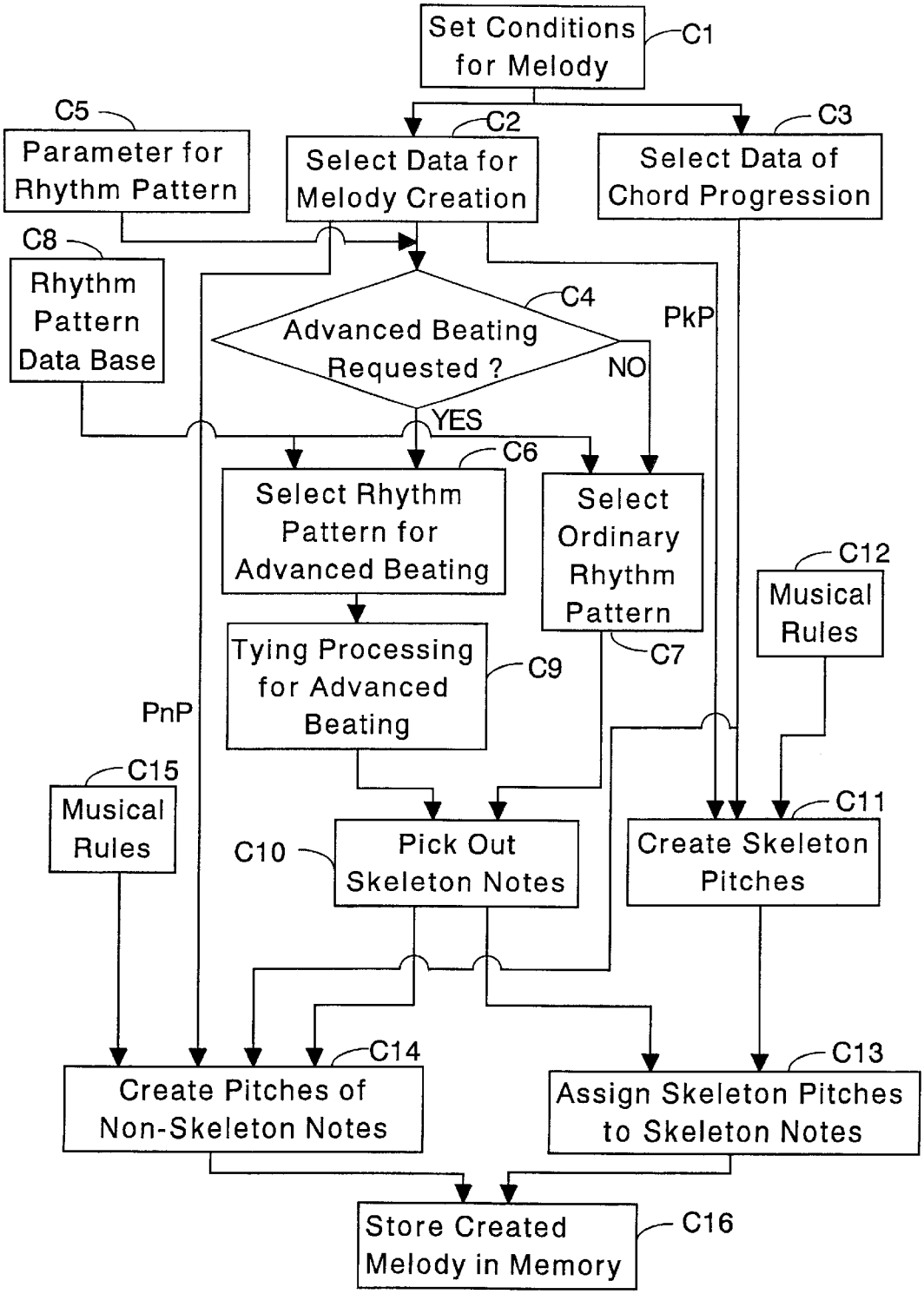

*Fig. 13a*
Forward Syncopation Using Rhythm Pattern Having Duration Data
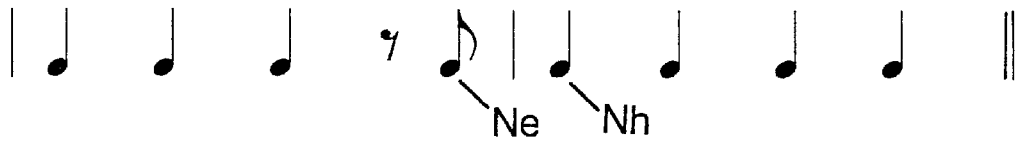
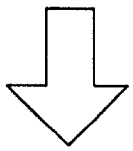
*Fig. 13b*
Forward Syncopation Using Rhythm Pattern Having Duration Data
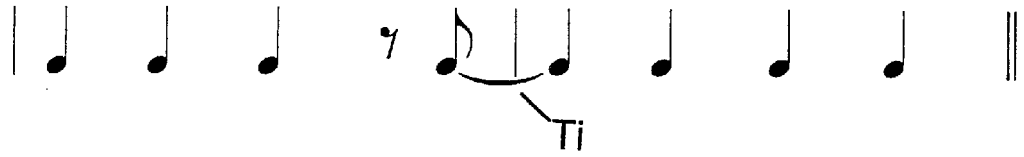

*Fig. 14a*
Forward Syncopation Using Rhythm Pattern Not Having Duration Data
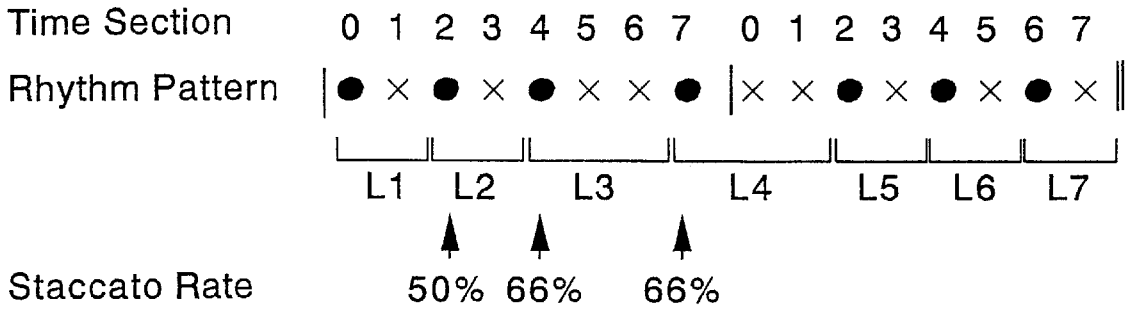
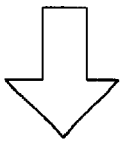
*Fig. 14b*
Forward Syncopation Using Rhythm Pattern Not Having Duration Data
After Processing
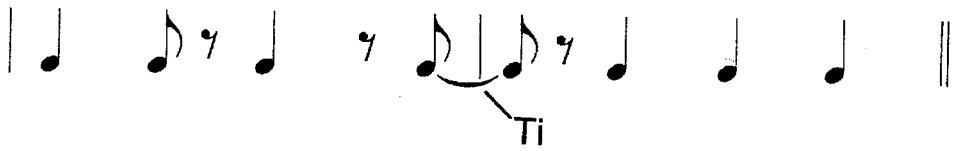

*Fig. 15* Melody Creation with Forward Syncopation (3)
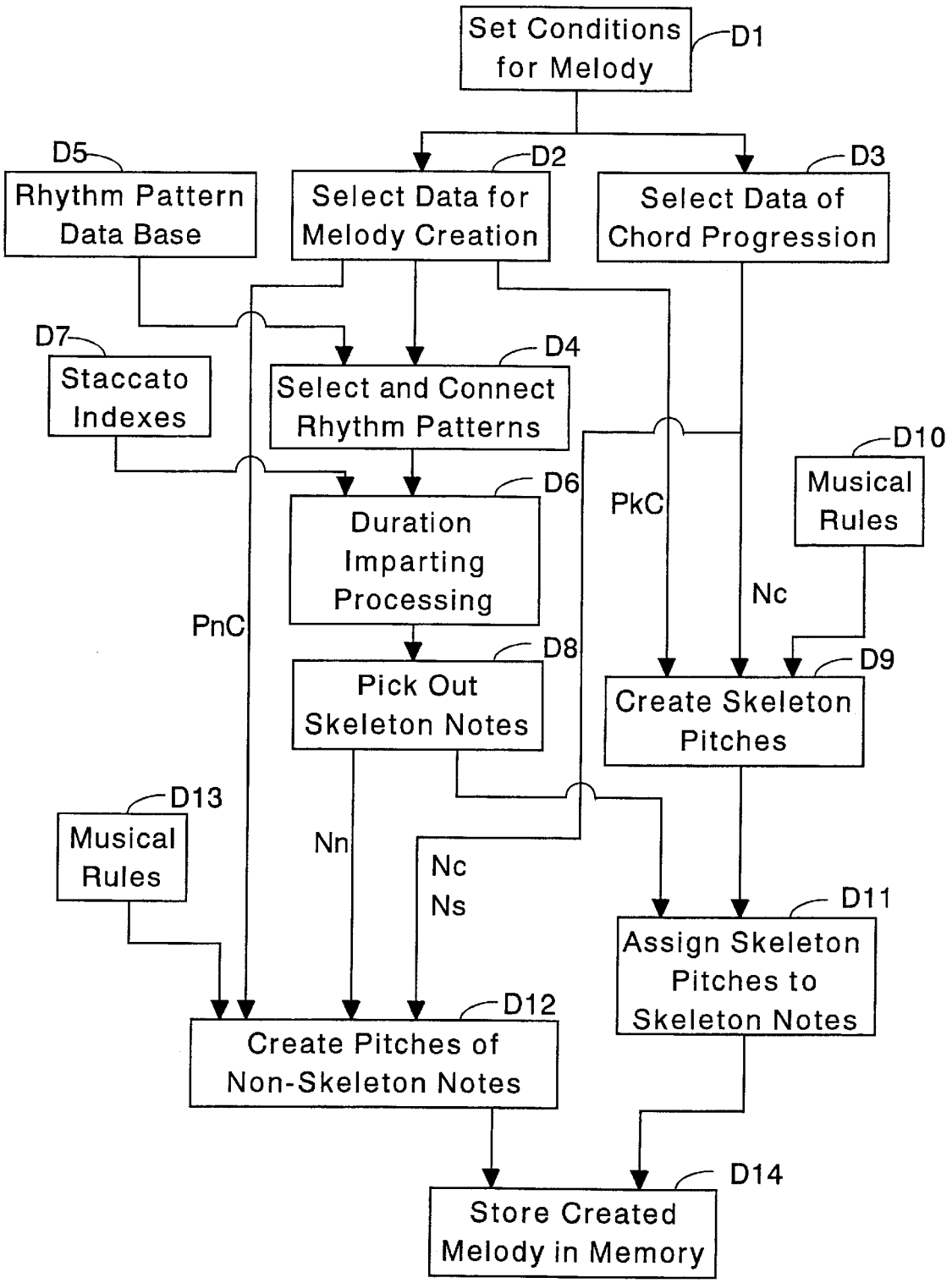

APPARATUS AND METHOD FOR CREATING MELODY DATA HAVING FORWARD-SYNCOPATED RHYTHM PATTERN

RELATED APPLICATION

This application claims priority from Japanese Patent Application No. 2000-015139, filed Jan. 25, 2000, the contents of which are incorporated hereinto by this reference.

BACKGROUND OF THE INVENTION

1. Field of the Invention

The present invention relates to an apparatus and a method for creating melody data having a forward-syncopated rhythm pattern, and a machine readable medium containing program instructions for realizing such an apparatus and a method using a computer system, and more particularly to an apparatus and a method capable of creating a melody having a forward-syncopated rhythm pattern from rhythm pattern samples without syncopation by forward-shifting a note position or positions in terms of time to realize advanced beating of a note or notes. The notes in the modified rhythm pattern are given respective note pitches to establish a melody. The skeleton notes in the rhythm pattern, i.e. notes of primary importance from a rhythmic point of view are given skeleton pitches, while the non-skeleton notes in the rhythm pattern, i.e. notes of secondary importance from a rhythmic point of view are given non-skeleton pitches. The advanced beating of a note makes a skeleton note which plays an important role in syncopation. The invention is applicable in various kinds of electronic musical apparatuses such as an electronic musical instrument, an automatic music composing apparatus, and a computer-system-configured music composing apparatus.

2. Description of the Prior Art

In music, a melody consists of notes respectively having note pitches and note durations and being aligned in a rhythmic pattern with respect to time progression. A rhythm is typically noticed or perceived as the repetition of regular occurrences of strong beats (including semi-strong beats) or down beats and weak beats or up beats, defining a meter. An alignment of the note beating time positions with various note durations (spans between the adjacent note beating positions) makes a rhythm pattern. The notes locating at the strong beats (including semi-strong beats) takes an important role from a rhythmic point of view, and may be termed as skeleton notes or primary notes, while the notes locating at the weak beats takes a less important role from a rhythmic point of view, and may be termed as non-skeleton notes (may be called "flesh notes" in contrast to "skeleton notes") or secondary notes.

In the conventional apparatuses and methods for creating a melody, the skeleton notes in a rhythm pattern are detected by a particular detection process. For example, the detection logic is that if there is a note at the position of a strong beat (e.g. the first and the third beat in the case of the quadruple meter), the note is detected as being a skeleton note, while if there is no note at the very position of a strong beat, a note which is close (ahead or behind) to the strong beat position is detected as being a skeleton note. The detection logic, therefore, is not simple. Further, according to the conventional logic, skeleton notes cannot be located freely according to the user's intention.

Among the melodies of the recent musical pieces, there are considerably many melodies having a forward-syncopated rhythm in which some notes are played a little bit earlier than the normal beat positions by forward-shifting the beating time of the note, i.e. by advance beating of the note. With the conventional technology of creating melodies, however, rhythm patterns are prepared and processed by the unit of measure (measure by measure), that is, rhythm patterns of the length of a measure or two (or more) are stored in the rhythm pattern data-base and pattern pieces are selected for the processing. Thus, the forward syncopation can be realized within a measure by employing a forward-shifted note or notes. But the forward syncopation cannot be realized over the adjacent measures (i.e. bridging the measures), and therefore the top note of a measure cannot be made a forward shifted note or forward syncopated note, as there is no note available for the forward syncopation processing before the top note within a measure.

SUMMARY OF THE INVENTION

It is, therefore, a primary object of the present invention to provide a novel type of melody creating apparatus and method, and a machine readable medium containing a program therefor capable of creating a melody in which skeleton notes can be arbitrarily nominated according to the user's intention without the need of a complicated algebraic logic for the detection of skeleton notes from among the notes constituting a given rhythm pattern. It is also an object of the present invention to provide a novel type of melody creating apparatus and method, and a machine readable medium containing a program therefor capable of creating a melody in which the top note in a measure can be forward-shifted to invade the end portion of the preceding measure. It is collectively an object of the present invention to create a melody having an abundance of rhythmic variety.

According to the present invention, the object is accomplished by providing a musical apparatus for creating melody data comprising: a rhythm pattern providing device which provides rhythm pattern data containing skeleton notes and non-skeleton notes; a note pick-out device which selectively picks out skeleton notes and non-skeleton notes; a skeleton note pitch providing device which provides note pitches for the skeleton notes; a skeleton note pitch imparting device which imparts the skeleton note pitches selectively to the picked-out skeleton notes, respectively; and a non-skeleton note pitch imparting device which imparts note pitches selectively to the non-skeleton notes, respectively. The rhythm pattern providing device may be a storage device which stores the rhythm pattern data containing skeleton notes and non-skeleton notes. The storage device may store skeleton indexes indicating which notes in the rhythm pattern are skeleton notes individually. Thus, the skeleton notes can be arbitrarily nominated according to the user's intention without the need of a complicated algebraic logic for the detection of skeleton notes from among the notes constituting a given rhythm pattern.

According to the present invention, the object is further accomplished by providing a musical apparatus for creating melody data comprising: a rhythm pattern providing device which provides rhythm pattern data representing a plurality of rhythm pattern pieces, each containing notes aligned on a time axis; a melody condition providing device which provides conditions for defining a melody to be created; a rhythm pattern selecting device which selects rhythm pattern pieces according to the conditions; a rhythm pattern string creating device which connects the selected rhythm pattern pieces, ties the notes at the connected portion of the rhythm patterns to realize a forward-shifted beating of note, thereby creating a length of rhythm pattern string having a forward syncopation feeling, and a pitch imparting device which imparts note pitches to individual notes in the length of rhythm pattern string. Thus, the top note in a measure can be forward-shifted to invade the end portion of the preceding measure.

According to the present invention, the object is further accomplished by providing a musical apparatus for creating melody data comprising: a rhythm pattern providing device which provides rhythm pattern data representing a plurality of rhythm pattern pieces, each containing notes aligned on a time axis, the notes being skeleton notes and non skeleton notes from a musical point of view; a melody condition providing device which provides conditions for defining a melody to be created; a chord progression providing device which provides a chord progression for a melody to be created; a rhythm pattern selecting device which selects rhythm pattern pieces according to the conditions; a rhythm pattern string creating device which connects the selected rhythm pattern pieces, ties the notes at the connected portion of the rhythm patterns to realize a forward-shifted beating of note, thereby creating a length of rhythm pattern string having a forward syncopation feeling; a note pick-out device which selectively picks out skeleton notes and non skeleton notes; a skeleton note pitch providing device which provides note pitches for the skeleton notes based on the conditions and the chord progression, a skeleton note pitch imparting device which imparts the skeleton note pitches selectively to the picked-out skeleton notes, respectively; and a non-skeleton note pitch providing device which provides note pitches for the non-skeleton notes based on the conditions and the chord progression, a non-skeleton note pitch imparting device which imparts note pitches selectively to the non-skeleton notes, respectively. The rhythm pattern pieces may contain information about note lengths, so that the rhythm pattern selecting device may select rhythm pattern pieces containing the information about note lengths. Alternatively, the rhythm pattern pieces may not contain information about note lengths, so that the rhythm pattern selecting device may select rhythm pattern pieces not containing information about note lengths, and the rhythm pattern string creating device may provide information of a note length covering the tied notes in creating the length of rhythm pattern string. The note pick-out device may pick out the note of the forward-shifted beating at the connected portion of the rhythm patterns as a skeleton note of the latter of the connected rhythm patterns. As the skeleton pitches are created based on the chord progression, the created melody has a clear and distinct melodic feeling with a stable backbone.

According to the present invention, the object is further accomplished by providing a musical apparatus for creating melody data comprising: a rhythm pattern providing device which provides rhythm pattern data representing a plurality of rhythm pattern pieces, each containing notes aligned on a time axis, the rhythm pattern pieces including rhythm patterns subjectable to forward syncopation processing and rhythm patterns not subjectable to forward syncopation processing; a forward syncopation designating device which selectively designates whether the forward syncopation processing is to take place, a rhythm pattern selecting device which selects the rhythm patterns subjectable to forward syncopation processing when the forward syncopation designating device designates the forward syncopation processing; a rhythm pattern string creating device which connects the selected rhythm patterns subjectable to forward syncopation processing when the forward syncopation processing is designated; a forward syncopation processing device which executes the forward syncopation processing to the connected rhythm patterns, thereby creating a length of rhythm pattern string involving forward syncopation; and a pitch imparting device which imparts note pitches to individual notes in the length of rhythm pattern string. Thus, a user can arbitrarily select a desired rhythm pattern pieces and realize advanced beating of a note or notes at any intended measures very easily, there by widening the musical feeling of the created melody.

As will be understood from the above description about the musical apparatus for creating melody data, a sequence of steps each performing the operational function of each of the structural element modules of the melody data creating apparatus will constitute an inventive method for creating melody data according to the spirit of the present invention.

Further as will be understood from the above description about the apparatus and the method for creating melody data, a storage medium containing a program executable by a computer system, which program comprising program modules for executing a sequence of the processes each performing the operational function of each of the structural element modules of the above melody creating apparatus or performing each of the steps constituting the above melody creating method will reside within the spirit of the present invention.

As will be apparent from the description herein later, some of the structural element modules of the present invention are configured by a computer system performing the assigned functions according to the associated programs. They may of course be hardware structured discrete devices performing the same functions.

The present invention may take form in various components and arrangement of components including hardware and software, and in various steps and arrangement of steps. The drawings are only for purposes of illustrating a preferred embodiment and processes, and are not to be construed as liming the invention.

BRIEF DESCRIPTION OF THE DRAWINGS

For a better understanding of the present invention, and to show how the same may be practiced and will work, reference will now be made, by way of example, to the accompanying drawings, in which:

FIG. 2 is an operational block diagram showing the overview of a first embodiment of the melody data creating processing according to the present invention, which executes a first type of forward syncopation processing, making use of stored skeleton note indexes;

FIG. 3*c* is a chart showing another example of the data format representing the rhythm pattern of FIG. 3*a;*

FIG. 3*d* is a chart showing a further example of the data format representing the rhythm pattern of FIG. 3*a;*

FIGS. 6*a*–*6d* are musical notations of rhythm patterns to be subjected to forward syncopation processing;

FIG. 6*e* is a musical notation of a rhythm pattern obtained through forward syncopation processing;

FIG. 7 is an operational block diagram showing the overview of a second embodiment of the melody data creating processing according to the present invention, which executes a first type of forward syncopation processing;

FIGS. 8 and 9 are, in combination, a flow chart showing an example of forward syncopation processing to be executed in the operational block B6 of FIG. 7;

FIG. 10 is a chart showing an example of the data format of still another rhythm pattern to be processed in the second embodiment of the present invention;

FIG. 11 is a flow chart showing another example of forward syncopation processing to be executed in the operational block B6 of FIG. 7;

FIG. 12 is an operational block diagram showing the overview of a third embodiment of the melody data creating processing according to the present invention, which executes a second type of forward syncopation processing;

FIGS. 13*a* and 13*b* are musical notations of rhythm patterns for explaining the forward syncopation processing according to the present invention, which makes use of the rhythm pattern data including note length data;

FIGS. 14*a* and 14*b* are musical notations of rhythm patterns for explaining the forward syncopation processing according to the present invention, which makes use of the rhythm pattern data not including note length data; and FIG. 15 is an operational block diagram showing the overview of a fourth embodiment of the melody data creating processing according to the present invention, which executes a third type of forward syncopation processing.

DESCRIPTION OF THE PREFERRED EMBODIMENTS

Figure 1:
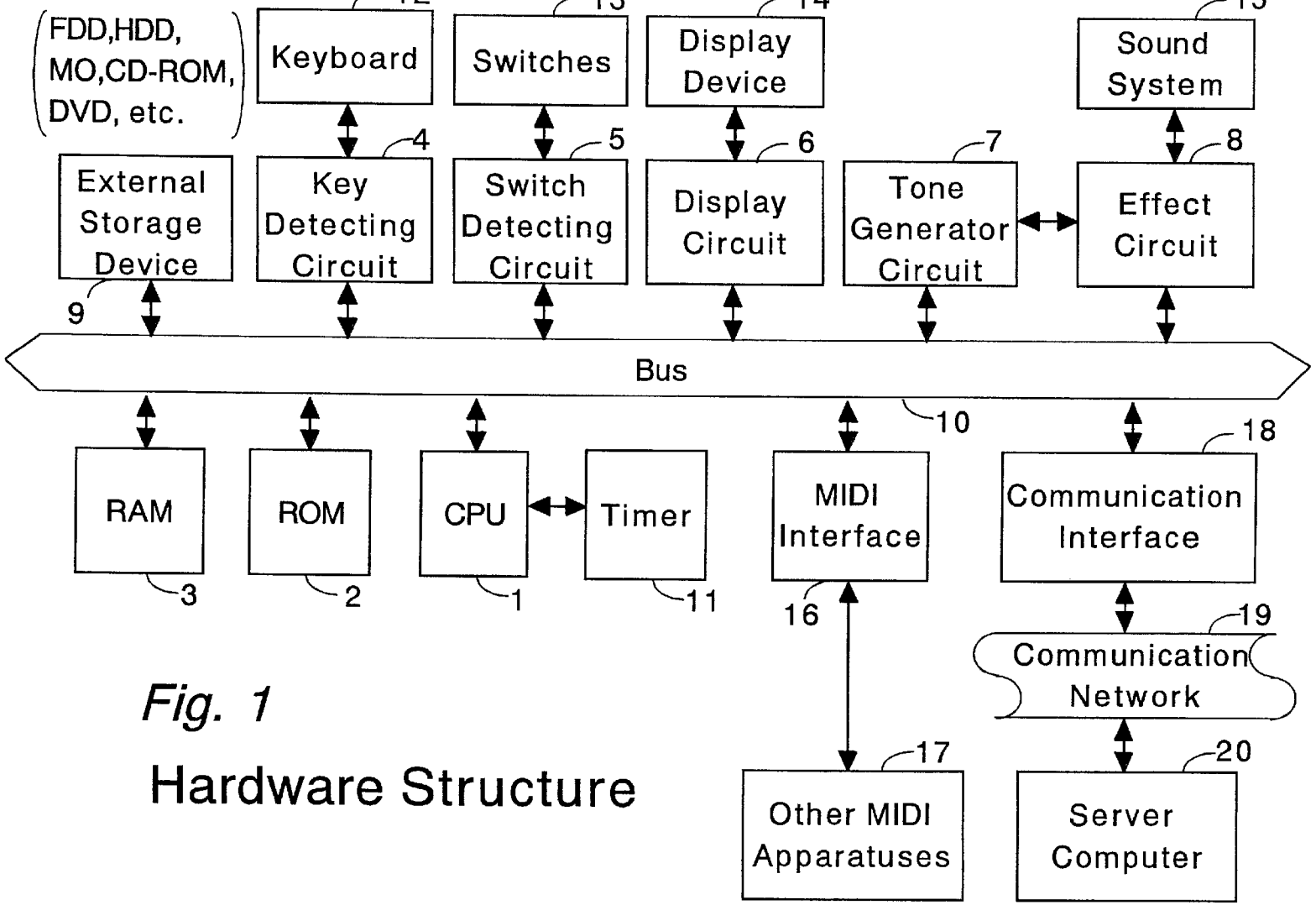
FIG. 1 is a block diagram showing the hardware structure of an example of a melody data creating apparatus according to the present invention.

FIG. 1 is a block diagram showing the hardware structure of an example of a melody data creating apparatus according to the present invention. The apparatus is constructed as a computer associated system operating under data processing software. The apparatus comprises a CPU (central processing unit) 1, a ROM (read only memory) 2, a RAM (random access memory) 3, a key detecting circuit 4, a switch detecting circuit 5, a display circuit 6, a tone generator circuit 7, an effect circuit 8 and an external storage device 9, all of which are connected with each other via a bus 10, thereby constituting a data processing system for creating melody data. The CPU 1 is to control the overall system and is connected with a timer 11, and executes various processing according to the prescribed programs, and in particular, centrally controls melody data creating processing, which will be described in detail hereinafter. The ROM 2 stores prescribed control programs for controlling the system. Included among the control programs are a program for basic performance information processing, a program for creating melody data according to the present invention various tables and various data. The RAM 3 is to store data and parameters used in connection with these processings, and is used as work areas for temporarily storing various registers, various flags, various data under processing.

The key detecting circuit 4 is connected to a manipulating device for a musical performance such as a keyboard 12 including manipulating keys or elements. The switch detecting circuit 5 is connected to manipulating switches 13 including switches for setting various modes, parameters and operations arranged on a switch panel, and more specifically a melody data creation mode designating button, a tonality key designating button and switches for selecting or designating various data. The display circuit 6 is connected with a display device 14 and various indicators, which may be arranged on the switch panel being juxtaposed with the switches 13 and may exhibit these switches in a manipulating fashion on the screen. The effect circuit 8 constituted by a DSP (digital signal processor) or the like is connected with a sound system 15, which constitutes a musical tone outputting device together with the tone generator circuit 7 and the effect circuit 8 to emit audible sounds based on performance data including the melody data created by the present data processing system.

The external storage device 9 may be a hard disk drive (HDD), a compact disk read only memory (CD-ROM) drive, a floppy disk drive (FDD), a magneto-optical (MO) disk drive, a digital versatile disk (DVD) drive or else, and stores various control programs and various data. Thus, the programs and various data (melody creation element data, chord progression data, rhythm creation parameter data, rhythm pattern data, musical rule data, etc.) for melody data creation processing may be stored not only in the ROM 2, but also in the associated storage medium in the external storage device 9, so that the programs and the data may be transferred in the RAM 3. The intermediate data and the result data established in the RAM 3 may be transferred to the external storage device 9.

In the embodiment of FIG. 1, a MIDI interface 16 is also connected to the bus 10, so that the system can communicate with other MIDI apparatuses 17. Further connected to the bus 10 is a communication interface 18, so that control programs and various necessary data can be obtained from a server computer 20 via a communication network 19 and can be stored in the external storage device 9.

FIG. 2 shows an operational block diagram of a first embodiment of the melody data creating processing according to the present invention. This embodiment picks out skeleton notes from the rhythm pattern, making use of skeleton note indexes stored in a rhythm pattern data base together with rhythm pattern data.

In the melody creating processing with this embodiment, a function block A1 is to set conditions for composing an intended melody such as the meter, the musical genre (category) and the structure (such as the number of measures, similarity or contrastiveness among musical sentences, e.g. A—A'-B–C, etc.) of a music piece. A function block A2 is to select data for melody creation, i.e. melody creation reference data containing details for melody creation (there are stored a number of sets of details with respect to various meters, musical genres, music structure) from among the stored data. A function block A3 is to select data of chord progression (here are stored a number of chord progressions with respect to various meters, musical genres, musical sentence structure, etc.).

The melody creation reference data include information about the existence of syncopation, the number of notes in a measure, the density of notes in the first and second halves of a measure in terms of rhythm and information about conditions for skeleton note pitches and conditions for non-skeleton note pitches. The conditions for skeleton pitches include the skeleton pitch dynamics defining the degrees of pitch jump among the skeleton notes (the variation width in pitch). The conditions for non-skeleton pitches include the degrees of pitch jump of the non-skeleton notes in terms of deviation amount from the skeleton note pitch jump. The chord progression data coins a series or sequence of chord names which vary along with the music progression (e.g. one chord name for every measure). These data are similarly employed in other embodiments which will be described hereinafter. The melody creation reference data also include musical rules which will be referred to in the creation of the pitches for the notes.

A function block A4 is to select from a rhythm pattern data base A5 a rhythm pattern which meets the details about the rhythm for melody creation as selected from the function block A2. Then a function block A6 picks out skeleton notes (i.e. beating time points) from the selected rhythm pattern. On the other hand, a function block A7 creates pitches for the skeleton notes based on the chord progression data (chord notes Nc of each chord in a chord sequence) from the block A3 and on the conditions PkC for the skeleton note pitches included in the details of the melody creation reference data from the block A2. The thus created pitches are assigned in a functional block A8 to the skeleton notes Nk picked out at the block A6.

A function block A9 creates pitches for the non-skeleton notes Nn based on the conditions PnC for pitch creation such as the pitch dynamics, the pitch data for the skeleton notes and the chord progression data (chord notes Nc and scale notes Ns). And finally, a function block A10 gathers the pitch imparted skeleton notes from the block A8 and the pitch imparted non-skeleton notes from the block A9 to compose a melody of an amount of one music piece, and stores the composed melody in a memory such as the external storage device 9

The creation of the skeleton pitches at the block A7 and the creation of the non-skeleton pitches at the block A9 may be conducted in other ways than described above. For example, the skeleton pitches may be created based on only the chord progression without using conditions for the skeleton pitches (for example, selecting randomly from among the chord notes irrespective of the pitch jump degree information). The pitches for the non-skeleton notes may be created without using the information about the pitch creation conditions and the skeleton pitches (for example, selecting randomly from among the scale notes (including the chord notes) irrespective of the pitch jump degree based on the skeleton pitches). Alternatively, the non-skeleton note pitches may be determined from among all of the twelve semitones, not limited to the seven scale notes, while the skeleton note pitches had better be determined from among the chord notes.

Figures 3A, 3B:
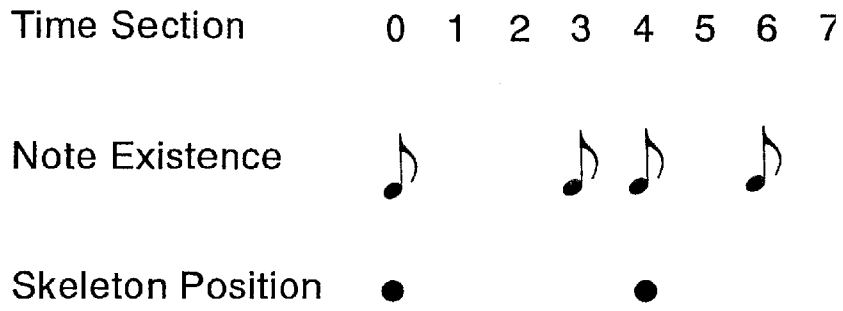
FIG. 3*a* is a chart showing an example of the data format of a rhythm pattern processed in the first embodiment of the present invention.
FIG. 3*b* is a chart showing a musical illusion of the rhythm pattern of FIG. 3*a;*

Now, an explanation will be made in more detail hereunder about how the function block A6 operates in picking out the skeleton notes from among a rhythm pattern, which operation constitutes one of the important features of the present invention. The data structure of the rhythm patterns contained in the rhythm pattern data base A5 is such as shown in FIG. 3*a*. The data format is of a time section mapping type. Each measure is divided into time sections Ts having a time span length which is the minimum available note length or duration (time resolution), and each of the time sections Ts carries a note mark Nb representing the existence or non-existence of a note in this time section and a skeleton mark Sk representing whether this time section is a skeleton time point or not. In this example, the length of one measure is divided into eight time sections, each section having a duration or time length of the eighth note. In the column of the note mark Nb, "1" means that there is a note in this time section, while "0" means that there is no note in this time section. In the column of the skeleton mark Sk, "1" means that this time section is a skeleton time point, which in turn means that the note, if any, existing in this time section is a skeleton note, while "0" means that this time section is a non-skeleton time point which in turn means that the note, if any, existing in this time section is a non-skeleton note.

Where there is a note at the strong beat, the note is typically a skeleton note. And, where there is no note at the strong beat, but there is a note or notes close to the strong beat just before or after the strong beat, the note which is closest to the strong beat usually makes a skeleton note. But this is not always so. In some particular genre of music, a note which dose not fall on the strong beat may be a skeleton note. By locating a skeleton note at a position which is not a strong beat, one can easily create a melody having a characteristic feeling of a particular musical genre. Other than a rhythm pattern of an ordinary allotment of skeleton marks, the data base may include a rhythm pattern or patterns which has the same arrangement (alignment) of note marks Nb, but has different skeleton marks. Such preparation will enable the creation of a melody or melodies exhibiting different musical feelings based on a same rhythm pattern.

The method for picking out the skeleton notes is that the stored rhythm pattern data will be read out by advancing the time section successively using an address counter, and by detecting a note existing indication "1" of the note mark Nb and a skeleton nomination "1" of the skeleton mark Sk: In the case of the rhythm pattern data #1 of FIG. 3*a*, the detected result will be as shown in FIG. 3*b*, in which notes (shown by eighth note symbols) exist time sections 0, 3, 4 and 6 according to the "1" marks of the note mark Nb and skeleton notes (shown by solid circle symbols) exist at time sections 0 and 4 according to the "1" marks of the skeleton mark Sk In this way, where the rhythm pattern data #1 of FIG. 3*a* is selected at the function block A4 of FIG. 2 and is subjected to the processing by the function block A6, the time sections Ts=0 and Ts=4 are picked out as skeleton notes, while the other note existing time sections Ts=3 and Ts=6 are detected to be non-skeleton notes for the processing at the function block A9.

In the above explanation, the rhythm pattern data is in the format of a time section mapping type in which "1" mark and "0" mark are stored at every time section of the minimum note length. The data format, however, may be another one such as in the event notation which describes only the note existing time sections Ts, FIG. 3*c* shows an example of the event notation about the same rhythm pattern #1 as FIG. 3*a*. The first column denotes the absolute time section numbers A of note existence from the top of the pattern (usually the measure) and the second column denotes the skeleton mark Sk indicating whether the time section is a skeleton note or not. According to the data format of FIG. 3*c*, the rhythm pattern data will be expressed in a two-digit data piece "A Sk" as "01", "30", "41" and "60".

A further alternative may be an event notation in a relative time expression. FIG. 3*d* shows an example of the event notation in the relative time expression, representing the same rhythm pattern data #1 as FIG. 3*c*. The first column denotes the number of time sections B from the preceding note existing time section (i.e. in the relative time expression) and the second column denotes the skeleton mark Sk indicating whether the time section is a skeleton note or not. According to the data format of FIG. 3*d*, the same rhythm pattern data as FIG. 3*c* will be expressed in a two digit data piece "B Sk" as "01", "30", "11" and "20". Comparing with the absolute time notation A, the relative time notation B requires less values for describing the time sections, but requires accumulation of the past time section values to identify each time section for the processing.

Figure 4:
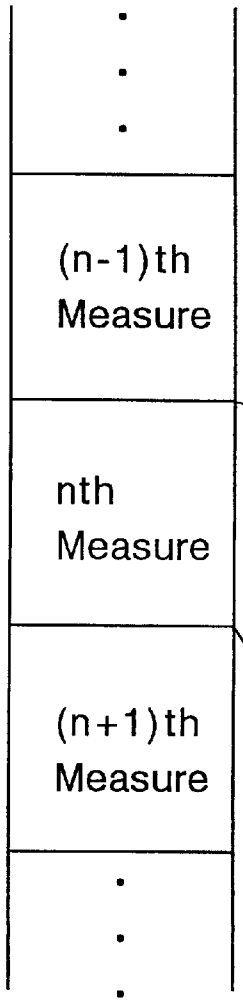
FIG. 4 is a chart showing an example of the data format of another rhythm pattern to be processed in the first embodiment of the present invention.

Although the above description is about the processing of the rhythm pattern data of a one-measure length, the rhythm pattern data may be of a two-measure length or longer, as the processing in the unit of a musical sentence or in the unit of entire musical piece involves rhythm pattern data for multiple measures. In order to cover such a longer rhythm pattern data, the data contains au upper bit added in the address data to indicate the measure number Br. In this example, the address counter points the measure number n and advances the time section count 0, 1, and so forth in detecting the existence of a note and the skeleton mark. While the data format of FIG. 4 is a time section mapping type, the format may be an event notation in either the absolute time expression or the relative time expression as shown in FIG. 3*c* or 3*d* before.

Figure 5A:
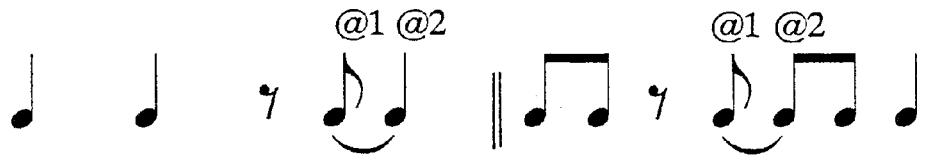
FIG. 5*a* is a musical notation of a rhythm pattern as processed to assume forward syncopation within the measure.
Figure 5B:
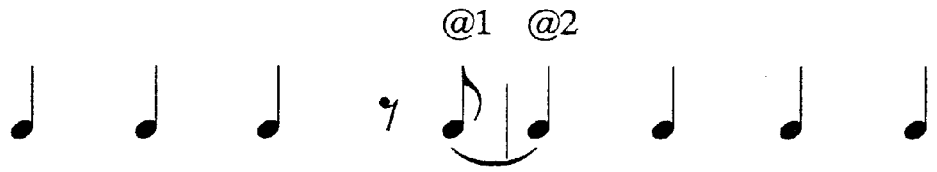
FIG. 5*b* is a musical notation of another rhythm pattern as processed to assume forward syncopation over the measures.

In the processing of the embodiment of FIG. 2, if the rhythm pattern data base A5 contains rhythm patterns with syncopated notes, the created melody contains syncopated notes having skeleton pitches imparted at the block A8. If the rhythm pattern extracted from the data base does not contain syncopation in the rhythm, the rhythm pattern can be modified to contain syncopation by forward-shifting a note or notes existing at the normal beat position to obtain advanced beating of a note or notes. FIG. 5*a* shows how to obtain a forward-syncopated rhythm from a normal beat rhythm. The left measure illustrates the case in which the original pattern has a quarter note at the first, second and fourth beats and a quarter rest at the third note, and then an eighth note is inserted at the second half of the third beat as shown by @1 just before the quarter note at the fourth beat as shown by @2, and finally tying the notes @1 and @2, thereby rendering advanced beating of the original note @2. Also in the right measure, the note @2 is shifted forward by inserting a quarter note @1 inserted just before the note @2 and tying the two. As long as a rhythm pattern is selected by the unit of one measure, the forward syncopation can be realized only within one measure. Namely, only intra-measure shifting of a note can be made, and no advanced beating of the top note of a measure can be made, as there is no space or rest before the top note. According to the melody creating system of present invention, a forward syncopation processing can realize inter-measure shifting of a note to obtain forward-syncopated rhythm pattern having an advanced beating of the top note of a measure. FIG. 5*b* illustrates such an example, in which the top note @2 of the following measure is shifted forward by inserting an eighth note @1 at the end of the preceding measure and tying the two notes. This realizes wide varieties of music in a rhythmic point of view.

As an example, the melody creating system as a general structure creates a rhythm pattern for an entire length of melody first, and then creates note pitches for the respective notes in the rhythm pattern, and finally imparting the respective note pitches to the respective notes in the rhythm pattern. In the processing, the skeleton notes in the rhythm pattern are picked out, and then note pitches for the skeleton notes determined from the chord data and the pitch dynamics are assigned to the skeleton notes, while note pitches for the non-skeleton notes are created to be imparted to the non-skeleton notes. In order to create a melody having a forward-syncopated rhythm, a novel method of forward syncopation processing is introduced in the invention. The present invention involves the following three types of forward syncopation processing, as examples Type 1: Selecting rhythm pattern pieces and connecting the selected rhythm pattern pieces to make a desired length of rhythm pattern, and thereafter modifying the rhythm into a forward-syncopated rhythm.

Type 2: Selecting rhythm pattern pieces having note duration data and being subjectable to forward syncopation processing, and thereafter connecting the selected rhythm pattern pieces, and finally tying the notes.

Type 3: Selecting rhythm pattern pieces not having note duration data but being subjectable to forward syncopation processing, and thereafter modifying the rhythm pattern into a forward syncopated rhythm pattern having note duration data.

The first type of forward syncopation processing will now be described hereunder with respect to a second embodiment using rhythm pattern illustration in the figures. In this embodiment rhythm pattern pieces are selected by a predetermined unit such as a measure according to the set conditions for the rhythm pattern of a melody including the condition as to the existence of syncopation, and the selected rhythm patterns are connected to constitute a desired length of rhythm. The desired length may be a block of a certain length or may be a whole length of music piece. The system then search for a portion or portions for the forward syncopation processing.

For the inter-measure shifting of the note beating, there are four situations. The first situation is shown in FIG. 6*a*, which includes a preceding measure subjectable to the inter-measure shifting and a following measure also subjectable to the inter-measure shifting. There is no note (i.e. there is a rest Re) at the end of the preceding measure and there is a note Nh at the top of the following measure. In this situation, a pickup note Ne of a quarter note length is inserted at the end of the preceding measure in place of the rest Re, and the inserted quarter note is tied together with the top note Nh of the following measure as shown in FIG. 6*c*. Thus, the advanced beating of the top note in the following measure will be realized.

The second through fourth situations are illustrated in FIGS. 6*b*–6*d*. In all of the three situations, the connecting portions of the preceding measure and the following measure are not suitable for the forward-shifting processing across the measures. But either or both of the last beat (note or rest) and the first beat (note or rest) are forcibly changed to the style of FIG. 6*e*.

The following explanation will be about the case in which the forward-shifting processing is conducted at a desired portion in the rhythm pattern from a musical point of view. However, any note may be forward-shifted to make a forward syncopated rhythm pattern. The resultant melody will be appreciated as a melody having a good rhythmic feeling with forward syncopation.

FIG. 7 shows an operational block diagram of the second embodiment of the melody data creating processing according to the present invention. This embodiment executes the first type of forward syncopation processing. This embodiment is to modify the connected rhythm pattern of FIG. 6*a* in which there is a rest (and therefore no note) at the end of the preceding measure into the rhythm pattern shown in FIG. 6*e* by inserting a fractional note Ne at the end of the preceding measure and tying the inserted note Ne with the first note Nh in the following measure. In the case of the FIG. 6*b* situation, this embodiment divides the last quarter note Ne to an eighth rest and an eighth note, places a quarter note as the top note of the measure for the quarter rest Rh, and connecting the eighth note Ne and the quater note Nb with a tie Ti as shown in FIG. 6*e*. In the FIG. 6*c* situation and the FIG. 6*d* situation, the similarly modified notes and rest, according to necessity, are processed to make the FIG. 6*e* result.

Similar to FIG. 2, in the embodiment of FIG. 7, a block B1 is to set conditions for determining a melody to be composed, and a block B2 and a block B3 select data for the melody creation (i.e. melody creation reference data) and data of the chord progression (a sequence of chord names, and chord notes and scale notes of each chord) in the melody to be created, respectively. The data for melody creation are supplied to a function block B4, which in turn selects rhythm pattern pieces from a rhythm pattern database B5 according to the conditions for melody creation such as existence of syncopation, and connects the selected rhythm pattern pieces. The connected rhythm patterns are transmitted to a block B6 of forward syncopation processing. When the forward syncopation processing is over, a length of rhythm pattern of a desired span is completed, and then a function block B7 picks out skeleton notes from the completed rhythm pattern. In the processing at the block B7, a forward-shifted top note of the following measure, i.e. the pickup note invading the end portion of the preceding measure is handled as a skeleton note, because the original location of the tied note was the first beat of the following measure. Thus advanced note is called an anticipation from a viewpoint of harmony, and functions as the top note of the following measure.

On the other hand, a function block B8 creates pitches for the skeleton notes based on the conditions PkC for the skeleton note pitches such as pitch dynamics included in the details of the melody creation reference data from the function block B2, on the chord progression data (e.g. chord notes Nc) from the function block B3 and on the musical rules form a function block B9. Then a function block B10 assigns the skeleton pitches created in the block B8 to the skeleton notes Nk picked out in the block B7. A function block B11 creates pitches of the non-skeleton notes Nn based on conditions PnC for the pitch creation extracted from the block B2, the chord progression data (e.g. chord notes Nc and scale notes Ns) from the block B3, the musical rules from the block B12 and the assigned skeleton note pitches notified from the block B10. And finally the pitch data thus created in the blocks B10 and B11 are collectively stored in the memory such as the external storage device 9 in a function block B13.

Now, an explanation will be made in more detail hereunder about how the function block B6 works in the forward syncopation processing according to type-1 processing. The philosophy of type-1 processing resides in that the system searches for portions musically adequate for advanced beating of the note and executes the processing, when there is a forward syncopation processing commanded. The processing involves a note and a rest at the connecting portion of two measures. In the case of FIG. 6*a* where there is a rest Re at the end of the preceding measure and there is a note Nh at the first beat of the following measure, the beating of the first note Nh of the following measure is shifted forward to invade the preceding measure. More specifically, as shown in FIG. 6*e*, the original quarter rest Re (FIG. 6*a*) at the end of the preceding measure is replaced by an eighth rest and an eighth note Ne (FIG. 6*e*), and the created eighth note Ne is connected with the top note Nb of the following measure using a tie Ti. The type-1 processing of this fashion is hereunder referred to as a forward syncopation processing type 1-A. Supplementally, as the first measure of a music piece or of a certain section (e.g. a musical sentence or phrase) has substantially no preceding measure, an additional measure should be places just before the first measure and a note should be created at the end of the added measure to be tied with the first note of the original first measure for the forward syncopation processing.

FIGS. 8 and 9 show, in combination, a flow chart of the above-mentioned type 1-A of forward syncopation processing to be executed in the operational block B6 of FIG. 7 in the second embodiment of the present invention. The symbol "n" denotes a variable representing the nth measure in the length of a music piece or musical section to be subjected to the processing. Steps S1–S5 are the processing for the first measure, as there is substantially no preceding measure before it, and accordingly constitute a little bit different processing from the process for the remaining measures as will be described with reference to FIG. 9. In the first place, the step S1 sets the measure number n="1", and the step S2 loads the rhythm pattern piece of the first measure. The rhythm pattern contains information as to the note beating time positions and the note durations (also the rest durations in the case of the event method notation). The step S3 checks whether there is a note at the first beat of the measure. If there is a note, the process proceeds to the steps S4 and S5 before a step S6 (FIG. 9), and if there is no note there, the process proceeds directly to the step S6.

The step S4 adds the (n−1)th measure before the nth measure, and creates a note at the end of the (n−1)th measure. In the case of the first measure (n=1), a new empty measure (to be termed as "0th measure") is added there and a note is placed at the end of the added 0th measure. The note to be placed there is preferably an eighth note or a sixteenth note. The next step S5 connects the note at the first beat of the nth measure to the added note at the end of the (n−1)th measure with a tie, so that the beating time of the first note in the nth measure invades the preceding measure. Thus, the first note of the nth measure starts sounding at the time point of the last note of the (n−1)th measure, thereby advancing the beating time.

Steps S6–S11 are for the processing of the connecting portion of the first and second measures, and the connecting portions between the adjacent measures thereafter. The step S6 loads the rhythm pattern pieces of the nth and the (n+1)th measures, where n>=1. The symbol ">=" means "is greater than or equal to" as is commonly used in the art. The step S7 examines whether there is no note for the period of the quarter note length or more at the end of the nth measure and there is a note at the first beat position of the (n+1)th measure, which means whether the connecting portion is adequate for the forward syncopation processing or not. If the examination result is affirmative (yes), the process moves forward to the steps S8 and S9 to execute the forward syncopation processing, and if the examination result is negative (no), the process goes to the step S10.

The step S8 creates a note at the end of the nth measure, and the step S9 ties the first note of the (n+1)th measure to the created note at the end of the nth measure. That is, the following note is tied to the preceding note to realize the advanced beating of the note. For example, if the situation is as shown in FIG. 6*a*, a note Ne is created at the end of the preceding measure (nth measure) and is connected to the first note Nh of the following measure ((n+1)th measure) with a tie Ti, as illustrated in FIG. 6*e*. The note Ne to be created should have a duration which does not exceed the note-absent span as represented by the rest Re, and should preferably be a sixteenth note or an eighth note, generally speaking. In the case of FIG. 6*a*, the last portion of the preceding (i.e. nth) measure is a note-absent span of the quarter note duration, namely a quarter rest, and the note created for this span is a note having a shorter duration than the quarter note. In the case of FIG. 6*e*, an eighth note Ne is placed with a preceding eighth rest (i.e. note absence of the eighth note duration) to substitute the original quarter rest of FIG. 6*a*.

After the forward syncopation processing at the steps S8 and S9, the process proceeds to the step S11 to judge whether the processing has been finished up to the last measure of the intended length of a music piece or a musical section. If the forward syncopation processing has been completed for all of the subjected measures, the forward syncopation processing of type 1-A is ended, while if not so, the processing is continued by going through the step S10 to increment the measure number n to n+1 to go back to the step S6, thereafter repeating the above described processing through the steps S6–S10 until the last measure has been finished.

In the above description, all of the portions which are suitable for the forward syncopation processing are subjected to the forward syncopation processing, but alternatively, an occurrence number parameter may be prepared so that such suitable portions should be randomly selected and subjected to the forward syncopation processing in the number limited by the occurrence number parameter. The occurrence number parameter may be determined individually for the respective musical genres of the melodies to be created. Further, whether to conduct the forward syncopation processing may be controlled with respect to the individual predetermined sections or spans such as the structural sentences. Further, in the case where the rhythm pattern piece as loaded at the step S2 or S6 has some syncopated rhythm portions inherently, the forward syncopated processing of the present invention may be so controlled as not to be conducted any more.

Next will be described about how the note-absent measure end is detected at the step S7. To begin with, there are two kinds of data expression for representing the note beating positions in a rhythm pattern. The one is the time section mapping method and the other is the event listing method.

In the time section mapping method, the time section which corresponds to the note beating time position stores note information Nt containing the note existence data Nx and the note length data Ln. The period from the time point where the duration of the last existing note in the measure ends up to the time point of the end (bar line) of the measure is the note-absent end of the measure, and is detected by the function block S7. FIG. 10 illustrates an example of data format storing of a rhythm pattern piece in the eighth-beat music. There are eight time sections "0", . . . "7", which correspond to the time sections Ts of FIG. 3*a*, and each time section carries the data Nx representing note existence "1") or absence ("0") and the data representing note length, collectively as the note information Nt. In this example, the note-absent measure end is the period from the time point where the duration Ln of time section 6 (i.e. the last note existing time section) until the end of the measure, which is the time span covering time section 7 only. The note length data Ln are provided in order to indicate whether the adjacent note existing time sections are of separate notes or of an continued note.

In the event listing method for this processing, the paired data of an event kind (note or rest) and a time length up to the following event are listed, and stored in the data base. If the last event in the rhythm pattern piece is a rest, the time length attached to this rest is taken as the note-absent measure end. While the above method contains data about the time length in the rhythm pattern data, the rhythm pattern data may alternatively contain the data about the note beating (starting) time points only, and the data about the note length may be attached afterward. In this case, as the data about the note length are added after the data about the note beating time have been stored, the length of the note-absent measure end will be shorter than the period from the beating time point of the last note in the measure up to the measure end. The example of this method of adding the note length data afterward will be described in detail herein later in connection with a fourth embodiment. In the case where there is an inherent pickup (i.e. a lead-in or an Auftakt) at the end of the preceding measure, the rhythmic invasion will be realized by further advancing the beating time of the pickup note to create a forward-shifted pickup note. If the thus forward-shifted pickup note conflicts with an originally existing note, the situation may be handled as "forward syncopation impossible" or the formerly existing note may be forcibly deleted to place the forward-shifted pickup note.

The type-1 processing of forward syncopation across measures can be applicable in the case of the rhythm pattern of FIG. 6*b* by adjusting the type-1 processing accordingly. In the FIG. 6*b* rhythm pattern there is a quarter note Ne at the end of the preceding measure and there is no note but a quarter rest Rh. In order to obtain the rhythm pattern of FIG. 6*e* from the rhythm pattern of FIG. 6*b*, a quarter note Nh is placed at the top of the following measure in place of the quarter rest Rh, and replacing the original quarter note Ne by an eighth rest and an eighth note Ne, then tying the eighth note Ne and the quarter note Nh. The type-1 processing of this fashion is herein referred to as a forward syncopation processing type 1-B.

The type 1-B processing is executed in the second embodiment of the melody data creating system as described hereinabove with reference to FIG. 7, similar to the case of the type 1-A processing. FIG. 11 shows a flow chart of the forward syncopation processing of type 1-B to be executed in the operational block B6 of FIG. 7.

In FIG. 11, a step S21 is to set the measure number n=1 to designate a rhythm pattern piece for the first measure. The next step S22 loads the rhythm patterns of the nth and the (n+1)th measure. The rhythm patterns contain the data of note beating time points and the durations of the notes (in the case of event listing method, the rests also). Then a step S23 examines whether there is no note for a time period of a predetermined length at the top of the (n+1)th measure and there is a note at the end of the nth measure, which means whether the connected portion of the two rhythm pattern pieces is suitable for the forward syncopation processing on not. If the judgment is affirmative (yes), the process moves forward to steps S24 and S25 to conduct the inter-measure forward-shifting processing, and if the judgment is negative (no) the process goes to a step S26.

The step S24 creates a note at the top of the (n+1)th note, and the step S25 lies the last note of the nth measure to the created top note of the (n+1)th measure, thereby obtaining the advanced beating of the note. In the case of the rhythm pattern of FIG. 6*b*, the note Nh is created at the top of the following measure ((n+1)th measure) and is connected to the last note Ne of the preceding measure (nth measure) using a tie. The note to be created here may be of any length as long as it does not exceed the note-absent span length defined by the rest Rh. Where the duration of the last note Ne in the preceding measure is longer the eighth note length, the last note Ne had better be divided into a rest+an eighth note (or a sixteenth note) before hand.

After the processing at the steps S24 and S25 have been executed, the process moves forward to a step S27 to judge whether the processing as been finished up to the last measure of the rhythm pattern string subjected to the processing. When the judgment is affirmative (yes), the processing of type 1-B will be terminated. And when the judgmnent is negative (no), the process goes to the step S26 to increment the measure number "n" to "n+1", and the processing through the steps S22 to S23 (or further to S24 to S27) will be repeated up to the last measure. Incidentally, the processing flow of FIG. 11 may include the steps S2–S5 of FIG. 8 between the step S21 and the step S22, so that the forward shifting can be executed against the first note of the first measure.

FIG. 12 shows an operational block diagram of a third embodiment of the melody data creating processing according to the present invention. This embodiment executes the forward syncopation processing in type 2 fashion. An example of rhythm pattern pieces which are very suitable for the forward syncopation processing is shown in FIG. 13*a*, in which the of each note contains the data of its duration. The rhythm pattern has a note Ne (the eighth note or shorter is preferable) at the end of the preceding measure and a note Nh at the first beat of the following measure. With this kind of rhythm pattern, mere connection of the last note Ne of the preceding measure and the first beat note Nh of the following measure using a tie Ti results in a forward-syncopated rhythm pattern as shown in FIG. 13*b*. In the type-2 processing for the forward syncopation, a pair of rhythm pattern pieces having no tie are provided first, and then the notes are connected with a tie.

In FIG. 12, a function block C1 is to set conditions for determining the melody, and a block C2 and a block C3 select data for the melody creation (i.e. melody creation reference data) and data of the chord progression (a sequence of chord names, and chord notes and scale notes of each chord) in the melody to be created, respectively. The data for melody creation include various information for determining a rhythm pattern such as existence of forward syncopation, the locations thereof and parameters, and are supplied to a function block C4. The block C4 judges whether the advanced beating processing for forward syncopation is requested at the respective portions of the intended rhythm patterns based on the various information for determining rhythm patterns included in the data for melody creation and on parameters for creating rhythm patterns supplied from a function block C5.

When the advanced beating processing for forward syncopation is requested, the judgment at the block C4 is affirmative (yes), and then the process of a function block C6 takes place. When the advanced beating processing is not requested, the judgment at the block C4 is negative (no), and then the process of a function block C7 takes place. The function block C6 selects rhythm pattern pieces suitable for advanced beating processing from among a rhythm pattern data base C8 and connects the selected rhythm pattern pieces. The function block C7 selects ordinary rhythm pattern pieces from among a rhythm pattern data base C8 and connects the selected rhythm pattern pieces. A function block C9 applies tying processing for advanced beating to the rhythm pattern data selected at the function block C6. The advanced beating processing at the block C9 is to delete the key-on data of the latter one of the tied notes and to alter the duration of the former note of the tied notes to a time length equal to the sum of the two durations. In the case of FIG. 13*b*, the last note (which was an eighth note) in the preceding measure now has the duration data meaning a dotted quarter note.

After the processing for advanced beating of the note is completed with respect to the rhythm patterns for forward syncopation through the function blocks C6 and C9 and the selection of the ordinary rhythm pattern is completed through the function block C7, a rhythm pattern string for one piece of music (melody) is prepared. Then a function block C10 picks out skeleton notes in the rhythm pattern string. In this picking-out processing, the notes which have been advance-shifted into the preceding measures are handled as skeleton notes, as they were originally the top notes in the measures. This type of notes are referred to as anticipations from a harmonic point of view. On the other land, a function block C11 creates skeleton pitches, i.e. pitches for the skeleton notes based on the parameters PkP for the skeleton note pitches such as pitch dynamics included in the details of the melody creation reference data from the function block C2, on the chord progression data from the function block C3 and on the musical rules form a function block C12.

Next, a function block C13 assigns the skeleton pitches created by the function block C11 to the skeleton notes picked out by the function block C10. On the other hand, a function block C14 creates pitches of the non-skeleton notes (i.e. the notes other than, i.e. between the skeleton notes as picked out at the function block C10) based on parameters PnP for the pitch creation extracted from the function block C2, the chord progression data from the function block C3, the musical rules from the function block C15, etc. And finally the pitch data thus created in the blocks B10 and B11 are collectively stored in the memory such as the external storage device 9 in a function block B13. Then, a function block C16 stores the thus created pitch data from the function blocks C13 and C14 into the memory such as the external storage device 9.

In the above described method, the following care should be taken in the case of applying a melody to a prepared lyric (words). Namely, if a rhythm pattern should be selected depending on the syllable number of the lyric, then there should be a discrepancy between the words syllable and the number of notes, as a tie causes one note beating to vanish. To solve such a drawback, a rhythm pattern having more notes than the word syllables by one is to be selected at the rhythm pattern selection.

A supplemental description about the processing through the function blocks C4–C9 will be made with respect to the decision of whether to conduct the forward syncopation processing of type 2 or not. The decision may depend on the indication of forward syncopation attached to the melody creation reference data for each span or section, or on such an indication being altered according to some occurrence frequency parameters, or may be made simply according to occurrence frequency parameters. Or, the forward syncopation may be neglected where there are already many syncopated portions in the selected rhythm pattern even though the forward syncopation processing is indicated in the data. The information as to the existence of syncopated portions may be contained in the rhythm pattern data or may be detected by computation from the rhythm pattern. The rhythm pattern data base may include information that the last note having a fractional beat length in the span (measure, sentence, or else) should be processed as an advanced beating of the first note of the following span, so that the forward syncopation processing will be conducted only at the portions having such information. Namely, there can be two types of method for deciding whether to conduct forward syncopation processing on not, 1) a method of deciding the conduction before the selection of the rhythm patterns as shown by the function block C4 of FIG. 12, and 2) a method of deciding the portion to apply the forward syncopation processing after the rhythm patterns are selected.

The third type of forward syncopation processing will now be described hereunder with respect to a fourth embodiment. In this embodiment, the stored rhythm pattern data contain the data indicating the beating time points only and do not contain duration data to indicate the respective durations i.e. time lengths of the respective notes. The duration data will be added afterward through the processing. FIGS. 14*a* and 14*b* illustrate rhythm pattern representations for explaining the type-3 processing of forward syncopation according to the present invention, in which the original rhythm pattern data do not contain duration and the processed resulting data contain the duration data. One measure is divided into eight time sections 0, 1, . . . 7.

In the type-3 processing, the rhythm pattern data base stores various rhythm pattern data pieces having only note mark data Nb representing note beating time points only and not durations. In the illustration of FIG. 14*a*, the note mark mean the existence of a note ("1") is expressed by a solid circle and the note mark meaning the non-existence of note ("0") is expressed by a symbol x. The time sections where a note beating exists are Ts="0", "2", "4" and "7" in the preceding measure and Ts="2", "4" and "6" in the following measure, that is there are seven notes there.

A particular rhythm pattern or patterns are selected from the rhythm pattern data base according to the conditions for rhythm creation (conditions for pattern selection) included in the melody creation reference data. With respect to the selected rhythm patterns, processing for posteriorly imparting durations to the notes are executed according the other rhythm creation conditions (duration restricting conditions.) An explanation will be made about an example of rhythm pattern shown in FIG. 14*a*. Under the standard state exerting no duration restriction, the duration for each note is established having an entire time length from the beating time point of the note till the beating time point of the next note (there may be placed a small gap just before the next note). for example, a duration L1 is created for the first note at time section Ts=0, and durations L2–L4 are created for the second through seventh notes, respectively, as shown in FIG. 14*a*. If there are data which restrict the durations of the notes such as staccato rate data (indicating by percentage or by simply a flag) as shown in the bottom line position of FIG. 14*a*, the durations of the notes are determined with reference to such duration restricting data. In the example of FIG. 14*a*, the second note is given a 50% restriction and the third and fourth notes are given a 66% restriction, while no restriction is given to other notes, which means a 100% restriction is given. Thus, the durations for the first through seventh notes in the pattern are L1, 0.5×L2, 0.66×L3, 0.66×L4, L5, L6 and L7, respectively.

As a result of the above processing, a rhythm pattern of the length of two measures as shown in FIG. 14*b* is obtained, in which the fourth note at the time section 7 has been modified as an eighth note at the end of the preceding measure tied (by Ti) with an eighth note at the top of the following measure is obtained, amounting to a quarter note duration, thereby realizing an advanced beating of a top note there. The tied portion across the measures does not necessitate a particular tying process of two notes, and the resultant duration bridging the two measures will automatically exhibit the tied notes in the musical notation.

FIG. 15 shows an operational block diagram of the fourth embodiment of the melody data creating processing according to the present invention, which utilizes the third type of forward syncopation processing. As in the heretofore described embodiments, a function block D1 is to set conditions for determining melody to be created, and a function block D2 and a function block D3 select data for the melody creation (i.e. melody creation reference data) and data of the chord progression (a sequence of chord names, and chord notes and scale notes of each chord) in the melody to be created, respectively, according to the conditions from the function block D1. The data for melody creation are supplied to a function block D4, which in turn selects rhythm pattern pieces which do not have duration data from a rhythm pattern data base D5 according to the conditions for rhythm creation contained in the melody creation reference data, and then connects the selected rhythm pattern pieces. The connected rhythm patterns are transmitted to a function block D6 for duration imparting processing. The function block D6 conducts the process of imparting the duration to each note in the rhythm pattern based on the staccato rate indexes (i.e. duration restricting instruction) supplied from the block D7.

After the durations are imparted to the notes at the function block D6, a function block D8 picks out skeleton notes from the rhythm pattern. On the other hand, a function block D9 creates pitches for the skeleton notes based on the conditions PkC for the skeleton note pitches such as pitch dynamics included in the details of the melody creation reference data from the function block D2, on the chord progression data (i.e. chord notes Nc) from the function block D3 and on the musical rules form a function block D10. Then a function block D11 assigns the skeleton pitches created in the block D9 to the skeleton notes picked out in the block D8. A function block D12 creates pitches of the non-skeleton notes Nn based on conditions PnC for the pitch creation extracted from the block D2, the chord progression data including chord notes Nc and scale notes Ns from the block D3, the musical rules from the block D13, etc. And finally the pitch data thus created in the blocks D11 and D12 are collectively stored in the memory such as the external storage device 9 in a function block D14.

Although some specific examples of melody creation processing including the forward syncopation processing according to the present invention have been described above, this invention may not be limited to those examples but may be variously modified to perform the contemplated functions without departing from the spirit of the present invention. For example, the melody to be created may be a polyphonic melody instead of a monophonic melody. Multiple melodies may be created anew, or a melody may be added to a previously prepared line of melody. The melody data of the present invention means accompaniment part data and bass part data which are melodic in nature as well.

The system configuration of the present invention may not be limited to the form of an electronic musical instrument, but may be constructed by a personal computer+application software. When configured as an electronic musical instrument, the form may not necessarily be limited to a keyboard type, but may be of a stringed instrument type, a wind instrument type, a percussion instrument type, or else. Further, the configuration may not necessarily be of a type in which a tone generator device, automatic performance device, etc. are incorporated in a main console of an electronic musical instrument, but may be of a type in which various devices are separately provided and are connected with each other by means of MIDI cables, communication networks, and other communication means. The various data to be used in the programs and the processing may be obtained from external storage devices or may be supplied to an electronic musical instrument or to a personal computer from external devices via a communication network and the communication interface.

Talking about the data format for the automatic performance, the format of the music data such as the data of the created melody or of the utilized chord progression may be of an "event+relative time" type in which each event is represented by the event identification and the relative time measured from the immediately preceding event, or an "event+absolute time" type in which each event is expressed by the event identification and the absolute time measured from the beginning of the tune or each measure, or may be a "pitch (rest)+duration" type in which the music progression is expressed by the pitch and the duration of each note and the duration of each rest, an "event mapping" type in which memory locations are secured and allotted for all of a plurality of minimum time units and all the events are written at the respectively corresponding time positions in the memory location, and may be any other arbitrary type. In the embodiments described in the above, there are note events and rest events as the performance events, rest events may be omitted by handling the non-existence of a note event to be a rest event.

Talking about the MIDI interface, the MIDI interface to be used in the present invention may not necessarily be a dedicated MIDI interface as designed exclusively for the present invention, but may be constructed by using a general purpose interface such as RS-232C, USB (universal serial bus) and IEEE-1394. Data other than the MIDI messages may also be transmitted concurrently with the MIDI messages.

According to the present invention, where the rhythm pattern data contains skeleton indexes (skeleton marks), the skeleton notes can be identified by merely reading out such indexes, and consequently a complex detecting process may be dispensed with, and also the skeleton notes can be arbitrarily nominated according to the composer's intention by freely placing the skeleton indexes in the data. This enables creation of wide variety of rhythmic patterns.

Further, according to the present invention, the rhythm pattern pieces of a predetermined length are selected and connected, and the forward shifting of the note beating time is applied at the connecting portion of the measures to construct an intended length of rhythm pattern, and the note pitches are imparted to the notes in the rhythm pattern. Even a note at the first beat of the measure can be processed to realize its advanced beating at the end of the preceding measure. A melody having such a rhythm pattern gives a beautifully syncopated feeling. Thus, a wide variety of melody from a rhythmic point of view will be created according to the present invention.

Further, according to the present invention, the rhythm pattern pieces of a predetermined length are selected based on the melody creation reference data and connected together, and then a forward syncopation processing is applied at the connection portion to make an intended length of rhythm pattern string, while skeleton pitches are created based on the melody creation reference data and the chord progression data and then are imparted to the skeleton notes picked out from the thus obtained rhythm pattern string, and also the pitches for the non-skeleton notes are created based on the melody creation reference data and the chord progression data. Therefore, a rhythm pattern string in which a note at a first beat of a measure is advanced in terms of beating time, invading the preceding measure can be created. This widens the rhythmic variety of music. As the skeleton pitches are created based on the chord progression, the created melody has a clear and distinct melodic feeling with a stable backbone.

Further according to the present invention, the rhythm pattern data base stores rhythm patters which are suitable for forward syncopation processing and rhythm patterns which are not suitable for forward syncopation processing, so that these rhythm patterns are selectively connected together to construct all intended length of rhythm pattern string and the pitches are imparted to the respective notes in the rhythm pattern string. And, for creating a rhythm pattern having forward syncopated portion, rhythm pattern pieces suitable for forward syncopation processing are selected from the storage and connected together, and the forward syncopation processing is applied to the connected rhythm pattern having a suitable portion for forward syncopation processing. Thus, a user can arbitrarily select a desired rhythm pattern pieces and realize advanced beating of a note or notes at any intended measures very easily, there by widening the musical feeling of the created melody.

As will be apparent from the description hereinabove, some of the structural element devices of the present invention are configured by a computer system performing the assigned functions according to the associated programs. They may of course be hardware structured discrete devices. Therefore, a hardware-structured device performing a certain function and a computer-configured device performing the same function should be considered a same-named device or at least an equivalent to each other.

While particular embodiments of the invention have been described, it will, of course, be understood by those skilled in the art that various alterations and modifications may be made without departing from the spirit, and that the invention is not limited thereto since modifications may be made by those skilled in the art, particularly in light of the foregoing teachings. It will be understood that the embodiments shown in the drawings and described above are merely for illustrative purposes, and are not intended to limit the scope of the invention. It is therefore contemplated by the appended claims to cover any such modifications that incorporate those features of these improvements in the true spirit and scope of the invention.

What is claimed is:

1. A musical apparatus for creating melody comprising:

a rhythm pattern providing device which provides rhythm pattern data containing skeleton notes and non-skeleton notes;

a note pick-out device which selectively picks out skeleton notes and non-skeleton notes;

a skeleton note pitch providing device which provides note pitches for said skeleton notes pitches for said skeleton notes;

a skeleton note pitch imparting device which imparts said skeleton note pitches selectively to said picked-out skeleton notes, respectively; and non-skeleton note pitch imparting device which imparts note pitches selective to said non-skeleton notes, respectively;

wherein said rhythm pattern providing device is a storage device which stores said rhythm pattern data containing skeleton notes and non-skeleton notes; and wherein said storage device stores skeleton indexes indicating which notes in the rhythm pattern are skeleton notes individually.

2. A musical apparatus for creating melody data comprising:

a rhythm pattern providing device which provides rhythm pattern data representing a plurality of rhythm pattern pieces, each containing notes aligned on a time axis;

a melody condition providing device which provides conditions for defining a melody to be created;

a rhythm pattern selecting device which selects rhythm pattern pieces according to said conditions;

a rhythm pattern string creating device which connects said selected rhythm pattern pieces, ties the notes at the connected portion of said rhythm patterns to realize a forward-shifted beating of note, thereby creating a length of rhythm pattern string; and a pitch imparting device which imparts note pitches to individual notes in said length of rhythm pattern string.

3. A musical apparatus for creating melody data comprising:

a rhythm pattern providing device which provides rhythm pattern data representing a plurality of rhythm pattern pieces, each containing notes aligned on a time axis, said notes being skeleton notes and non skeleton notes from a musical point of view;

a melody condition providing device which provides conditions for defining a melody to be created;

a chord progression providing device which provides a chord progression for a melody to be created;

a rhythm pattern selecting device which selects rhythm pattern pieces according to said conditions;

a rhythm pattern string creating device which connects said selected rhythm patterns pieces, ties the notes at the connected portion of said rhythm patterns to realize a forward-shifted beating of note, thereby creating a length of rhythm pattern string;

a note pick-out device which selectively picks out skeleton notes and non skeleton notes;

a skeleton note pitch providing device which provides note pitches for said skeleton notes based on said conditions and said chord progression;

a skeleton note pitch imparting device which imparts said skeleton note pitches selectively to said picked-out skeleton notes, respectively; and a non-skeleton note pitch providing device which provides note pitches for said non-skeleton notes based on said conditions and said chord progression;

a non-skeleton note pitch imparting device which imparts note pitches selectively to said non-skeleton notes, respectively.

4. A musical apparatus for creating melody data as claimed in claim 3, wherein said rhythm pattern pieces contain information about note lengths; and said rhythm pattern selecting device selects rhythm pattern pieces containing said information about note lengths.

5. A musical apparatus for creating melody data as claimed in claim 3, wherein said rhythm pattern pieces do not contain information about note lengths; and said rhythm pattern selecting device selects rhythm pattern pieces not containing information about note lengths; and said rhythm pattern string creating device provides information of a note length covering said tied notes in creating said length of rhythm pattern string.

6. A musical apparatus for creating melody data as claimed in claim 3, wherein said note pick-out device picks out the note of said forward-shifted beating at said connected portion of the rhythm patterns as a skeleton note of the latter of the connected rhythm patterns.

7. A musical apparatus for creating melody data comprising:

a rhythm pattern providing device which provides rhythm pattern data representing a plurality of rhythm pattern pieces, each containing notes aligned on a time axis, said rhythm pattern pieces including rhythm patterns subjectable to forward syncopation processing and rhythm patterns not subjectable to forward syncopation processing;

a forward syncopation designating device which selectively designates whether the forward syncopation processing is to take place;

a rhythm pattern selecting device which selects said rhythm patterns subjectable to forward syncopation processing when said forward syncopation designating device designates the forward syncopation processing;

a rhythm pattern string creating device which connects said selected rhythm patterns subjectable to forward syncopation processing, when the forward syncopation processing is designated;

a forward syncopation processing device which executes the forward syncopation processing to said connected rhythm patterns, thereby creating a length of rhythm pattern string involving forward syncopation; and a pitch imparting device which imparts note pitches to individual notes in said length of rhythm pattern string.

8. A musical apparatus for creating melody data comprising:

a rhythm pattern storage device which stores rhythm pattern data representing a plurality of rhythm pattern pieces, each containing notes aligned on a time axis, said rhythm pattern pieces including at least one first type of rhythm pattern having a rest at the end of the pattern, at least one second type of rhythm pattern having a note at the top of the pattern, at least one third type of rhythm pattern having no rest at the end of the pattern and no note at the top of the pattern;

a forward syncopation designating device which selectively designates the creation of either a melody having a forward-syncopated note at a connection point of rhythm pattern pieces or a melody not having a forward-syncopated note at a connection point of rhythm pattern pieces;

a rhythm pattern selecting device which selects said first and second types of rhythm pattern pieces when said forward syncopation designating device designates the creation of a melody having a forward-syncopated note at the connection point of the rhythm pattern pieces, and does not select both of said first and second types of rhythm pattern pieces from among said first, second and third types of rhythm pattern pieces when said forward syncopation designating device does not designate the creation of a melody having a forward-syncopated note at the connection point of the rhythm pattern pieces;

a rhythm pattern string creating device which connects, when the creation of a melody having a forward-syncopated note is designated, said selected first and second types of rhythm pattern pieces in the order mentioned, introduces a fractional note within and at the end of the duration of said rest in the preceding one of the connected patterns, ties said introduced note to said top note in the following one of the connected patterns to realize a forward-shifted beating of note, thereby creating a length of rhythm pattern string involving forward syncopation; and a pitch imparting device which imparts note pitches to individual notes in said length of rhythm pattern string.

9. A method for creating a melody data using a computer including a storage device, the method comprising:

a step of providing rhythm pattern data containing skeleton notes and non-skeleton notes;

a step of selectively picking out skeleton notes and non-skeleton notes;

a step of providing note pitches for said skeleton notes;

a step of imparting said skeleton note pitches selectively to said picked-out skeleton notes, respectively;

a step of imparting note pitches selectively to said non-skeleton notes, respectively; and a step of storing skeleton indexes in a storage device, wherein the skeleton indexes indicate which notes in the rhythm pattern are skeleton notes individually.

10. A method for creating a melody using a computer including a storage device, the method comprising:

a step of providing rhythm pattern data representing a plurality of rhythm pattern pieces, each containing notes aligned on a time axis;

a step of providing conditions for defining a melody to be created;

a step of selecting rhythm pattern pieces according to said conditions;

a step of creating a rhythm pattern string by connecting said selected rhythm pattern pieces, tying the notes at the connected portion of said rhythm patterns to realize a forward-shifted beating of note, thereby creating a length of rhythm pattern string; and a step of imparting note pitches to individual notes in said length of rhythm pattern string.

11. A method for creating a melody using a computer including a storage device, the method comprising:

a step of providing rhythm pattern data representing a plurality of rhythm pattern pieces, each containing notes aligned on a time axis, said notes being skeleton notes and non skeleton notes from a musical point of view;

a step of providing conditions for defining a melody to be created;

a step of providing a chord progression for a melody to be created;

a step of selecting rhythm pattern pieces according to said conditions;

a step of creating rhythm pattern string by connecting said selected rhythm pattern pieces, tying the notes at the connected portion of said rhythm patterns to realize a forward-shifted beating of note, thereby creating a length of rhythm pattern string;

a step of selectively picking out skeleton notes and non skeleton notes;

a step of providing note pitches for said skeleton notes based on said conditions and said chord progression;

a step of imparting said skeleton note pitches selectively to said picked-out skeleton notes, respectively; and a step of providing note pitches for said non-skeleton notes based on said conditions and said chord progression;

a step of imparting note pitches selectively to said non-skeleton notes, respectively.

12. A method for creating a melody using a computer including a storage device, the method comprising:

a step of providing rhythm pattern data representing a plurality of rhythm pattern pieces, each containing notes aligned on a time axis, said rhythm pattern pieces including rhythm patterns subjectable to forward syncopation processing and rhythm patterns not subjectable to forward syncopation processing;

a step of selectively designating whether the forward syncopation processing is to take place;

a step of selecting said rhythm patterns subjectable to forward syncopation processing when said forward syncopation designating device designates the forward syncopation processing;

a step of creating a rhythm pattern string by connecting said selected rhythm patterns subjectable to forward syncopation processing, when the forward syncopation processing is designated;

a step of executing the forward syncopation processing to said connected rhythm patterns, thereby creating a length of rhythm pattern string involving forward syncopation; and a step of imparting note pitches to individual notes in said length of rhythm pattern string.

13. A storage medium storing a program that is executable by a computer, the program comprising:

a module for providing rhythm pattern data containing skeleton notes and non-skeleton notes;

a module for selectively picking out skeleton notes and non-skeleton notes;

a module for providing note pitches for said skeleton notes;

a module for imparting said skeleton note pitches selectively to said picked-out skeleton notes, respectively;

a module for imparting note pitches selectively to said non-skeleton notes, respectively; and a module for storing skeleton indexes, wherein the skeleton indexes indicate which notes in the rhythm pattern are skeleton notes individually.

14. A storage medium storing a program that is executable by a computer, the program comprising:

a module for providing rhythm pattern data representing a plurality of rhythm pattern pieces, each containing notes aligned on a time axis;

a module for providing conditions for defining a melody to be created;

a module for selecting rhythm pattern pieces according to said conditions;

a module for creating a rhythm pattern string by connecting said selected rhythm pattern pieces, tying the notes at the connected portion of said rhythm patterns to realize a forward-shifted beating of note, thereby creating a length of rhythm pattern string; and a module for imparting note pitches to individual notes in said length of rhythm pattern string.

15. A storage medium storing a program that is executable by a computer, the program comprising:

a module for providing rhythm pattern data representing a plurality of rhythm pattern pieces, each containing notes aligned on a time axis, said notes being skeleton notes and non skeleton notes from a musical point of view;

a module for providing conditions for defining a melody to be created;

a module for providing a chord progression for a melody to be created;

a module for selecting rhythm pattern pieces according to said conditions;

a module for creating rhythm pattern string by connecting said selected rhythm pattern pieces, tying the notes at the connected portion of said rhythm patterns to realize a forward-shifted beating of note, thereby creating a length of rhythm pattern string;

a module for selectively picking out skeleton notes and non skeleton notes;

a module for providing note pitches for said skeleton notes based on said conditions and said chord progression;

a module for imparting said skeleton note pitches selectively to said picked-out skeleton notes, respectively; and a module for providing note pitches for said non-skeleton notes based on said conditions and said chord progression;

a module for imparting note pitches selectively to said non-skeleton notes, respectively.

16. A storage medium storing a program that is executable by a computer, the program comprising;

a module for providing rhythm pattern data representing a plurality of rhythm pattern pieces, each containing notes aligned on a time axis, said rhythm pattern pieces including rhythm patterns subjectable to forward syncopation processing and rhythm patterns not subjectable to forward syncopation processing;

a module for selectively designation whether the forward syncopation processing is to take place;

a module for selecting said rhythm patterns subjectable to forward syncopation processing when said forward syncopation designating device designates the forward syncopation processing;

a module for creating a rhythm pattern string by connecting said selected rhythm patterns subjectable to forward syncopation processing, when the forward syncopation processing is designated;

a module for executing the forward syncopation processing to said connected rhythm patterns, thereby creating a length of rhythm pattern string involving forward syncopation; and a module for imparting note pitches to individual notes in said length of rhythm pattern string.

* * * * *